United States Patent [19]

Meschi

[11] 4,421,590

[45] Dec. 20, 1983

[54] APPARATUS FOR THE SPLICING OF SHEET MATERIAL, PARTICULARLY FOR THE CONTINUOUS FEEDING OF FAST PRINTING MACHINES

[75] Inventor: Luciano Meschi, Leghorn, Italy

[73] Assignee: Wully S.A., Panama

[21] Appl. No.: 276,014

[22] Filed: Jun. 22, 1981

[30] Foreign Application Priority Data

Jun. 23, 1980 [IT] Italy ..... 22961 A/80
Jan. 26, 1981 [IT] Italy ..... 19335 A/80

[51] Int. Cl.[3] ..... B31F 5/00; G03D 15/04
[52] U.S. Cl. ..... 156/506; 156/157
[58] Field of Search ..... 156/157, 159, 502, 505, 156/506, 304.1, 545, 384, 388; 242/58.1–58.5, 59

[56] References Cited

U.S. PATENT DOCUMENTS 4,252,597 2/1981 Monroe ..... 156/505
4,289,556 9/1981 Booth ..... 156/506 X

OTHER PUBLICATIONS

IBM Technical Disclosure Bulletin, vol. 13, No. 2, Jul. 1970, Continuous Fanfold Paper Feed by R. P. Crawford, One p.

*Primary Examiner*—William A. Powell
*Attorney, Agent, or Firm*—McAulay, Fields, Fisher, Goldstein & Nissen

[57] ABSTRACT

A method and an apparatus for the splicing of sheet material, especially for forms made up as packages containing the forms as a continuous accordion folded strip, particularly for the continuous feeding of fast printing machines wherein the bottom form group of each package is placed sideways in respect to the lying plane of the forms within the package, whereby the last form of the in-feeding package is spliced to the first form of another package, the apparatus comprising a splicing plane consisting of two semiplanes whereupon the two sheets or forms to be spliced are placed and retained, upon having spread along the splicing line a length of adhesive tape and having the same sized and trimmed, apparatus being furthermore provided for pressing the edges of the two sheets to be spliced against the adhesive face of the tape, and apparatus for the final trimming of the spliced junction.

19 Claims, 34 Drawing Figures

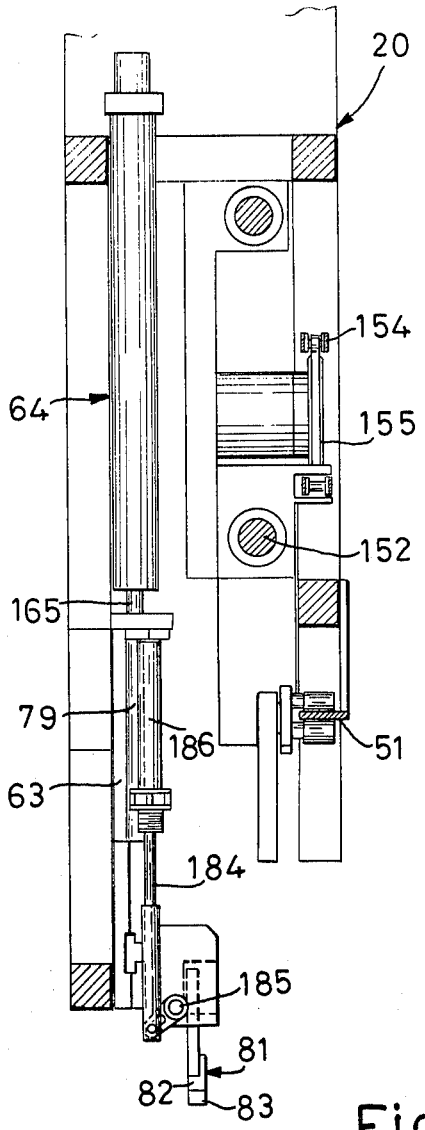
Fig. 21
Fig. 13A
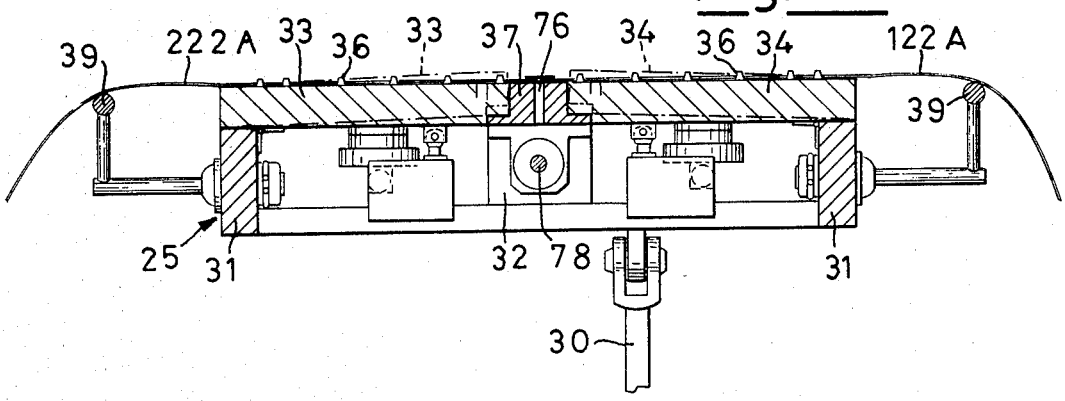

APPARATUS FOR THE SPLICING OF SHEET MATERIAL, PARTICULARLY FOR THE CONTINUOUS FEEDING OF FAST PRINTING MACHINES

BACKGROUND OF THE INVENTION

The present invention concerns a method and an apparatus for the continuous feeding of fast printing machines, in particular the printing units of data processing centers that utilize supports or forms, joined as a continuous strip and folded in an accordion or fan-fold way.

The present invention thus relates to a method and an apparatus for the automatic or semi-automatic splicing of sheet material, particularly of forms made up as packages utilized in the feeding of data processing center printing machines that utilize "folded" forms or supports.

More specifically, the present invention concerns an apparatus for the automatic or semi-automatic splicing of packaged forms of the kind wherein the form has a predetermined configuration and hollow punching that, once printed and processed, will make envelope items (known also as pre-enveloped items) ready for mailing.

Typical specimens of said forms are the invoice or bills from general facilities, as those issued by electric or telephone companies etc. It is known that fast printing machines are fed with forms arranged into packages wherein the forms in question are united amongst themselves along two opposed margins and folded accordion like the ones on the others. Up to now, when a form package had been completely utilized by the machine, a new form package had to be provided and settled by the operator and the printing machine could thereupon restart operation.

In this manner, some inconveniences are experienced with modern fast printing machines, as hereinafter briefly described:

(a) dead times, that is the times required to insert a new form package for the printing machine feeding that amount to 25–30%, and in some instances to 50% of the time utilized by the machine to process a form package;

(b) during the loading and insertion of a new form package the printing machine remains inactive and subjected to thermal and dynamic transients harmful to its correct operation.

Thus the operator is compelled to continuous and enervating attention and work, in that an absence of mind, even temporarly, on his part would result in very long dead times considering the times employed by a fast printing machine in utilizing and processing a single form package.

The main purpose of the present invention is that of doing away with the above problems and inconveniences and, in particular, of providing a method and apparatus that, even maintaining substantially unaltered the utilization of form conventional packages, wherein the single forms are already pre-printed and eventually arranged for the self-enveloping, will permit continuous feeding of the fast printing machine, thus eliminating the dead times in machine operation and hence, as a last result, of the data processing center. The specific scope of the present invention is to provide an apparatus for splicing in a semi-automatic manner the last form (that is the bottom form) of a package, in particular a form package already being fed to a printing unit, with the first form of another package.

A particular scope of the present invention is that of providing an apparatus having features as stated in the previous paragraph wherein the pre-formed die cut hollows of the forms are complied with and also the in-splicing-forms are utilizable without becoming scraps when processed by a fast printing unit. It will be evident, in effect, that a splicing inaccurately carried out, as it could be theoretically supposed, would imply the need to discard two forms (the last of a package and the first form of a successive one) with very remarkable complications within the printing unit cycle (especially if the unit is a laser or fast printing in character).

SUMMARY OF THE INVENTION

In order to achieve the above stated purposes, the present invention provides a method for the continuous feeding of fast printing machines, of the character wherein the single forms of each package are picked up from the upper end of the same package, still in the condition wherein the forms are united amongst themselves, along two opposed edges, forming a continuous stripe, characterized by the fact that the lower forms of each form package are sideways placed, either parallel or perpendicular to the lying down plane of forms within the package, and means are provided to bring into coplanar alignment the package last form being fed to the printing machine and the first form of a successive form package and means for splicing among themselves the edges of said last and first forms.

The present invention further provided an apparatus for the automatic or semi-automatic splicing of forms or sheet material characterized by including a splicing plane; means for temporarily withholding the two splicing sheets on said splicing plane with the adjacent edges of the two splicing sheets being kept in a desired position one in respect to the other; means for the application of a splicing adhesive tape movable between a tape drawing location wherefrom the same is fed and a predetermined location, whereof the adhesive tape is placed along a predetermined trajectory in respect to the two splicing adjacent edges; cutting means for the cutoff and trimming of said adhesive tape in correspondence to its two ends and to intermediate areas wherein splicing is not desired.

According to the preferred embodiment of the present invention apparatus, said splicing plane consists of two semi-planes being divided along the line or profile along which the splicing has to be carried out between said edges of adjacent sheets or forms to be spliced, said semi-planes being movable between a splicing location, wherein they are perfectly coplanar, and an adjusting location wherein the edges of the two semiplanes corresponding to said splicing line protrude by a predetermined distance in respect to the common lie plane during the splicing phase.

In turn, said means for temporarily holding said splicing sheets on said splicing plane consist of a suction or vacuum source communicating with openings made in the two semi-planes constituting said splicing plane, said opening being closed or covered by said splicing forms or sheets when splicing is being performed.

The means for adhesive tape feeding consist of a roller suitable for carrying an adhesive tape roll, preferably of the character arranged with pinholes or a shearing line, corresponding to the tear separation line between two successive forms of a form package, and of a rocking arm between a resting location wherein the adhesive tape is hooked, and an operating location wherein the adhesive tape is kept against a slider and uncoiled by the feeding roll, the slider laying off said adhesive tape along said splicing line on said splicing plane, thereupon said cutting and trimming means becoming operative.

In the particular instance of hollow punched forms, that is forms including an internal portion, pliable along a median line, a frame that encompasses only one of the two halves so defined by said median line, and a second more external framing strip thereby having between this second strip and the very final form a void area obtained through hollow punching or die cutting, the cutting and trimming means being articulated in order to cut and trim said adhesive tape corresponding to said void area, as the splicing would be otherwise imperfect and the two forms could not be processed into the printing unit.

BRIEF DESCRIPTION OF THE DRAWINGS

The features and advantages peculiar to the method and apparatus in accordance with the invention will appear more clearly from the following detailed description, made in connection with attached drawings, wherein.

FIG. 13A is a cross-section view of the splicing plane according to the lines III—III of FIG. 13;

FIG. 21 is a cross-section view of the splicing frame taken along the lines IV—IV of FIG. 20.

DETAILED DESCRIPTION OF THE PREFERRED EMBODIMENTS

Figure 3:
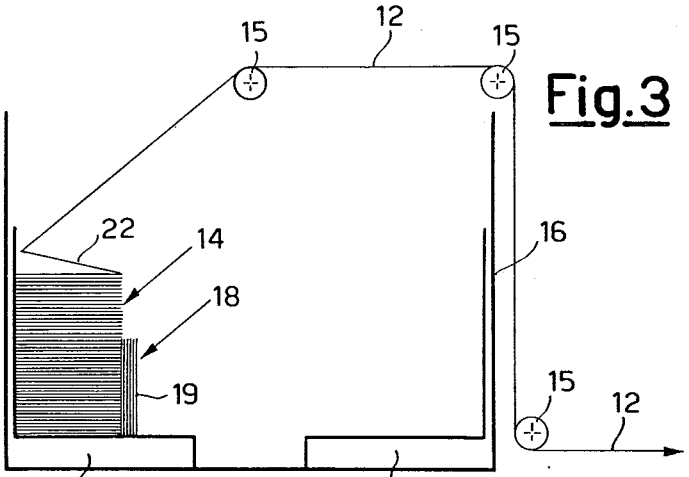
FIGS. 1, 2, 3, 4, 5 and 6 show diagrammatically the implementation phases of the method of the present invention according to a first embodiment.
Figure 4:
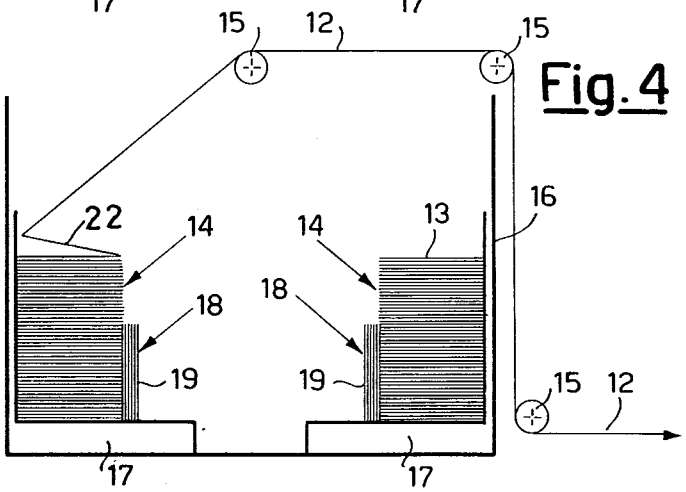
Figure 1:
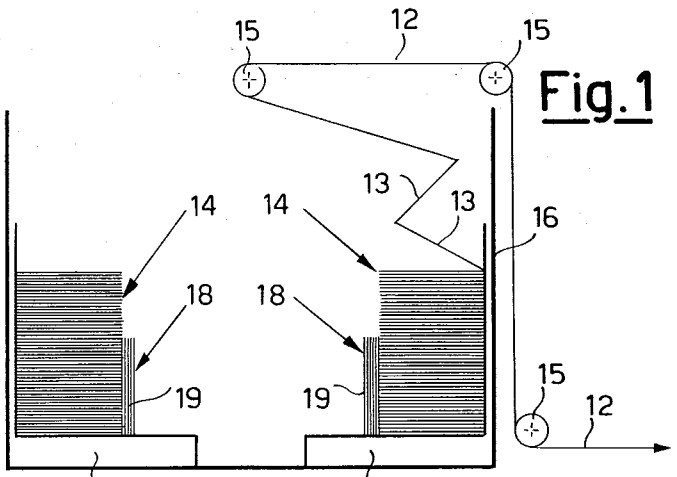
Figure 2:
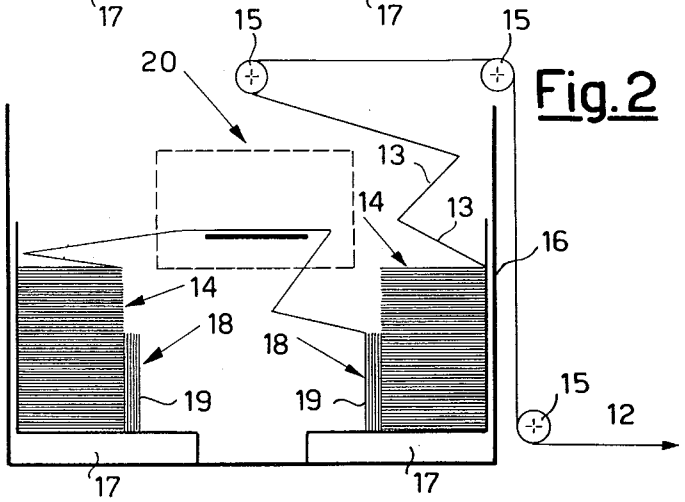
Figure 7:
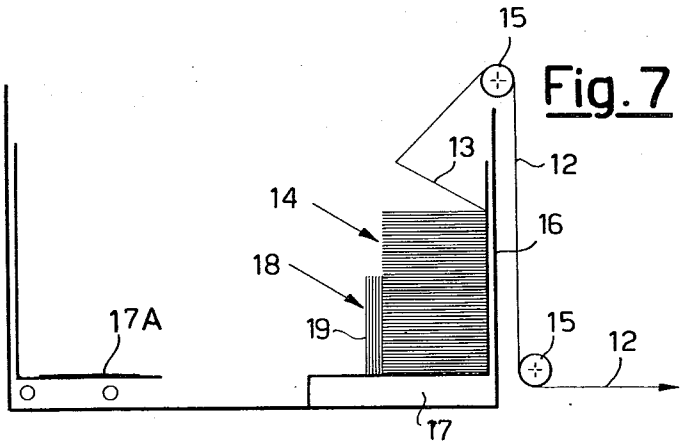
FIGS. 7, 8, 9 and 10 are views similar to FIGS. from 1 to 6 of a second embodiment.
Figure 8:
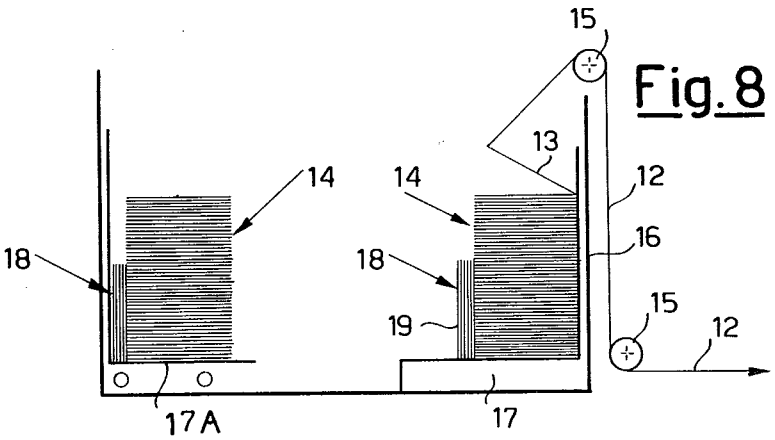
Figure 5:
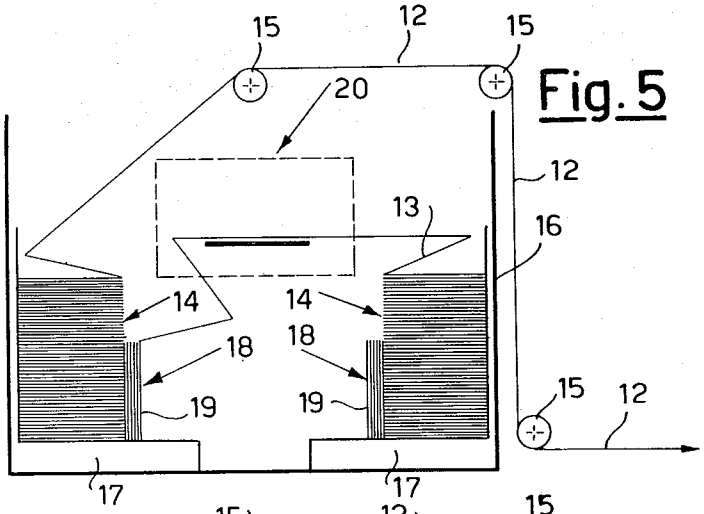
Figure 6:
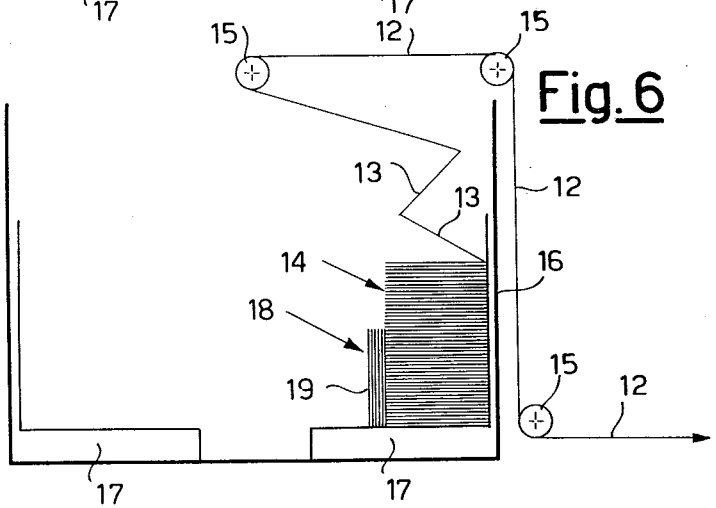
Figure 9:
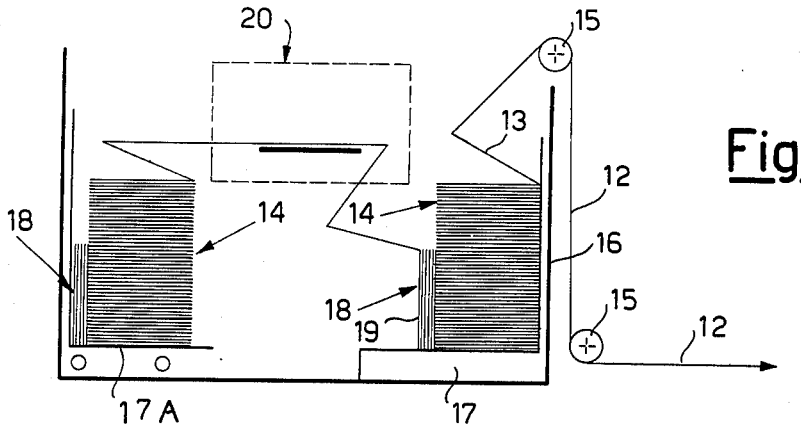
Figure 10:
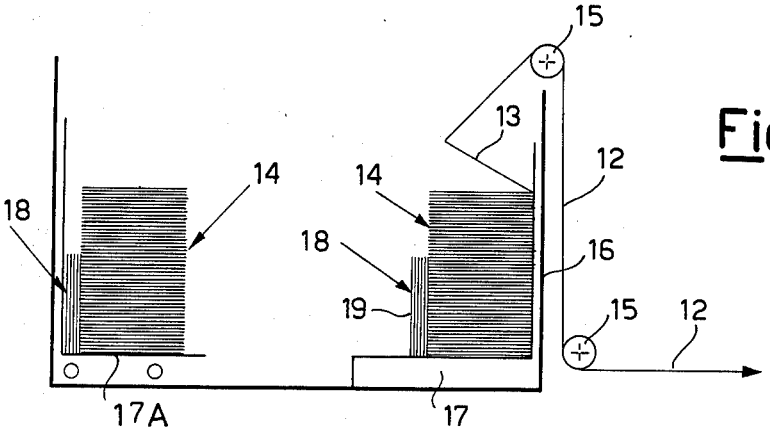

Referring first to FIGS. 1 through 6, with the number 12 is illustrated the continuous ribbon of forms 13, united amongst themselves, that is being picked up from package 14.

For guiding the ribbon 12 rollers 15 are provided so that the ribbon is fed into correct position to the printing machine (not shown).

As it will be clearly seen from the figures, the package 14 is housed within an open container 16, on a stationary support 17, and shows a group of forms (indicated with number 18) placed sideways in respect to support 17, thereby the most external form of group 18 is the last form 19 of package 14.

Within the container 16 there is provided a second support 17, whereon is positioned another package 14 of forms having likewise the group 18 of forms placed sideways.

With number 20 is generically indicated the splicing apparatus as hereinafter more detailedly illustrated in the FIGS. 11 to 31.

As it can be seen from the succession of FIGS. from 1 to 6, while ribbon 12 is feeding the printing machine from the right hand package 14, the form 19 of the package in question is picked up, by means of pick up devices of well known character, for instance suckers placed at the end of rotatable arms between a position wherein the suckers engage the sheet or form 19, and a position wherein the same form, by unwinding of form group 18 is placed on a splicing plane.

As will be seen from FIG. 3, once the splicing operation has been completed, when the right hand feeding package 14 is exhausted, feeding is continued with the left hand package 14 that had just been spliced, while a next package 14 is being placed on the right hand support 17 and splicing is carried out in the already described manner.

Moreover, in this manner correct positioning problems of forms in respect to the printing machine do not arise, as the pick up of the same from packages 14 will be always in the same direction and starting from the summit.

In the embodiment shown in the FIGS. from 7 through 10, into the container 16 there are provided a stationary support 17 and a trolley or movable support 17A, which receives the splicing package 14 and when the same is in the feeding stage, will transfer it on the stationary support, thus remaining available to receive a new splicing package.

Turning now to the FIGS. 11 through 31, there is illustrated, without any limiting meaning, a preferred embodiment of the splicing apparatus which includes a frame 20, in combination with a support table 21 particularly useful for splicing form packages (indicated generally with number 22) having two delimiting boards 23 and 24.

It is to be noted that some minor differences are shown with respect to FIGS. 1 to 10, regarding the package support means.

The frame 20 supports a splicing plane, indicated in its entirety with number 25, and a splicing head, indicated generically with number 26.

Figure 11:
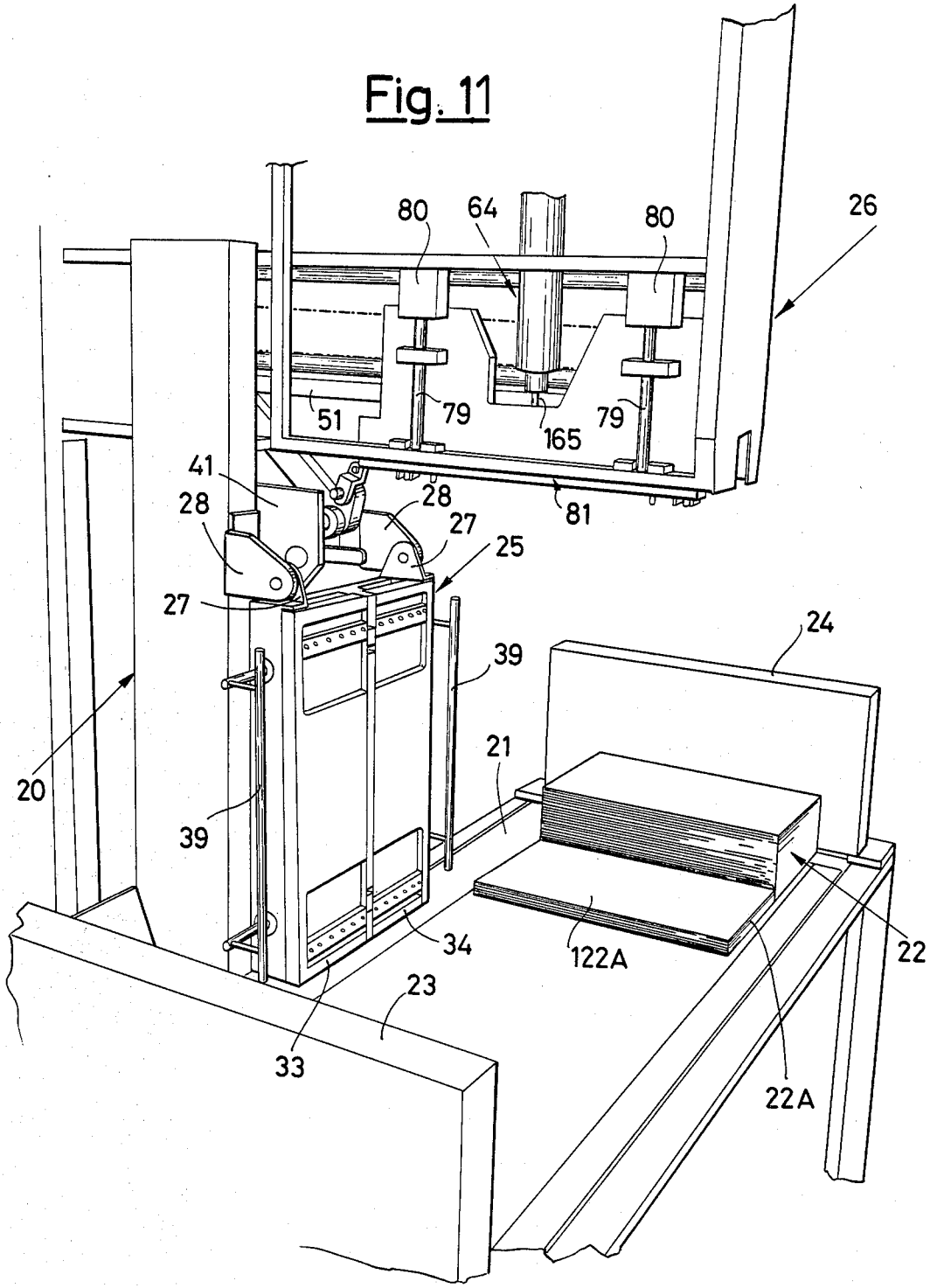
FIGS. 11 and 12 are general perspective views of the apparatus in accordance with the invention in resting and operating condition respectively.
Figure 12:
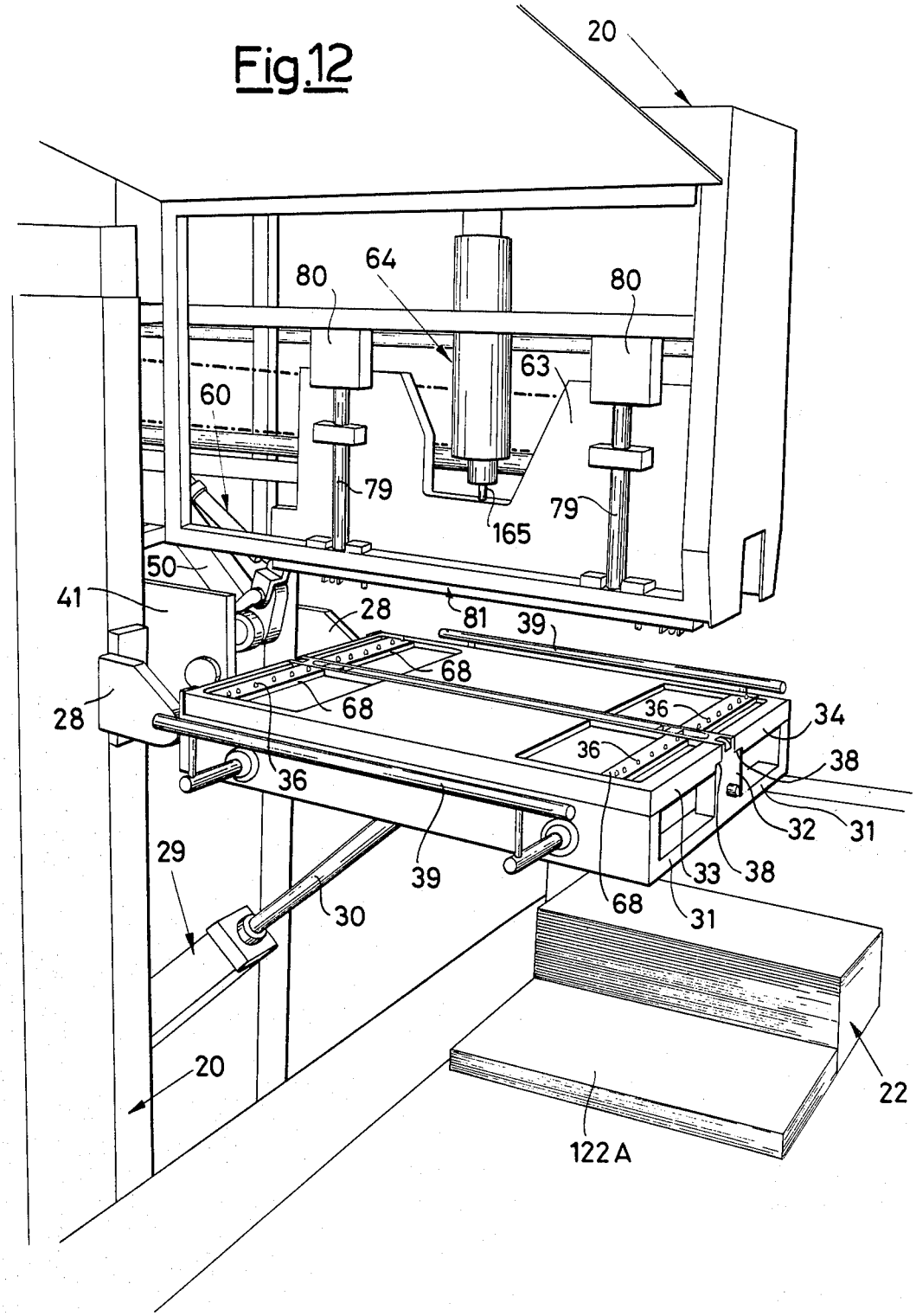

The splicing plane 25 is mounted so as to be rotatable between the resting position shown in FIG. 11 and the operational position shown in FIG. 12 by means of ears 27 journalled to brackets 28 secured to the frame 20.

The rotation of plane 25 from one to the other position is carried out in a controlled manner by means of a pneumatic or hydraulic jack 29, wherein the rod 30 has the outer end pivotally connected to the lower surface of plane 25.

The latter includes a channel shaped lower base 31, having along its centerline, a partition 32 wherein the median line (M) is conicident with the line along which the desired splicing must occur.

On its uppermost portion the splicing plane 25 consists of two semi-planes 33 and 34, identical and symmetrical to each other which are hingedly secured along the outer most edge, whereby the two semi-planes can take two positions (for the purpose as hereinafter explained) wherein their corner adjacent to the splicing line M is respectively either at level or raised in respect to the horizontal plane passing through the above said splicing line, the two positions being obtained in a controlled manner by means of a raising and return piston housed below each semi-plane and being driven in timed relationship with the operating cycle of the whole apparatus.

Into each semi-plane 33 and 34, slits are formed, generally indicated with number 35, which are connected with one or more common headers as formed internally to plane 25, the headers being connected with a suction or vacuum source, the activation of which permits retaining on each semi-plane 33 and 34 a splicing sheet or form thereon placed.

In the instance where the splicing sheets or forms have marginal drillings (as in the case of forms intended for processing in machines or data processing or accounting centers) rows of pins or stakes 36 are provided on the semi-planes and spaced of a length equal to the step or space of said drillings on said forms or sheets. As a consequence also the thickness of the central partition 32 or its upper working face, indicated with number 37, will be equal to one or more above said steps.

As it will be clearly seen from the figures, partition 32 has symmetrically a step portion 38 having the purpose of forming a firm support for the internal side of each semi-plane 33, 34 when in working position wherein it is level with the working face 37 of partition 32.

Finally, along the two opposite sides of plane 25 there are provided two guide bars 39 for the sliding of splicing sheets or forms when they respectively are the last and the first sheet of two form packages connected in a continuous manner and folded.

Considering now the splicing head 26, the following devices and mechanisms are therein provided:

(1) an adhesive tape feeding assembly for the splicing;
(2) a trolley for picking up and laying off said adhesive tape;
(3) a blade assembly for cutting and trimming said adhesive tape once laid off in place;
(4) a presser assembly for the splicing;

These devices and mechanisms, that correspond to functions accomplished by the machine at each splicing operation, will be now described with reference to a preferred embodiment, it being understood that changes and modifications are conceptually and mechanically possible and foreseeable, without falling out of the scope of the invention.

Figure 15:
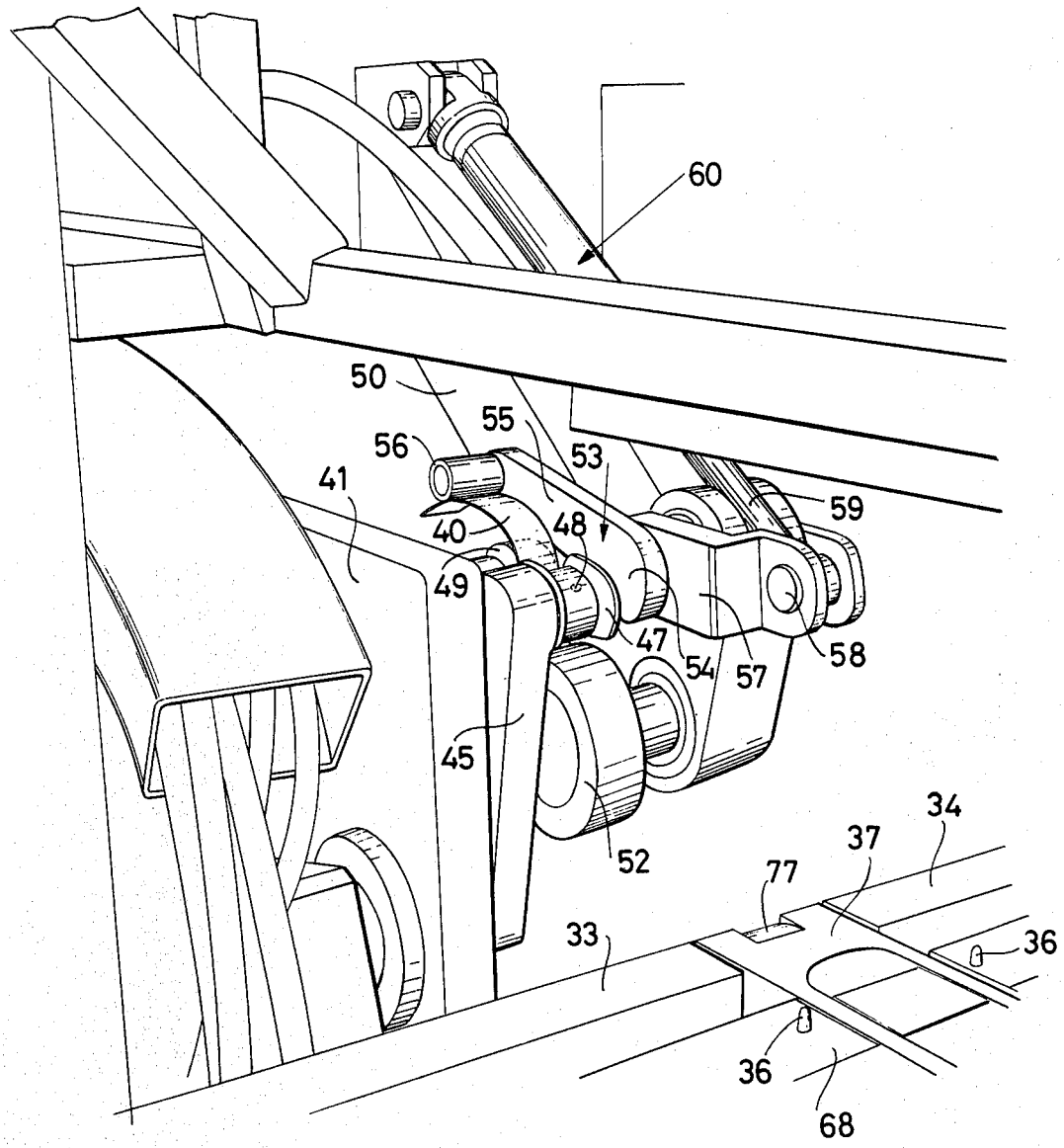
FIGS. 15 and 15A are detailed views of hooking and laying off of the splicing adhesive tape and of the respective feeding means.
Figure 15A:
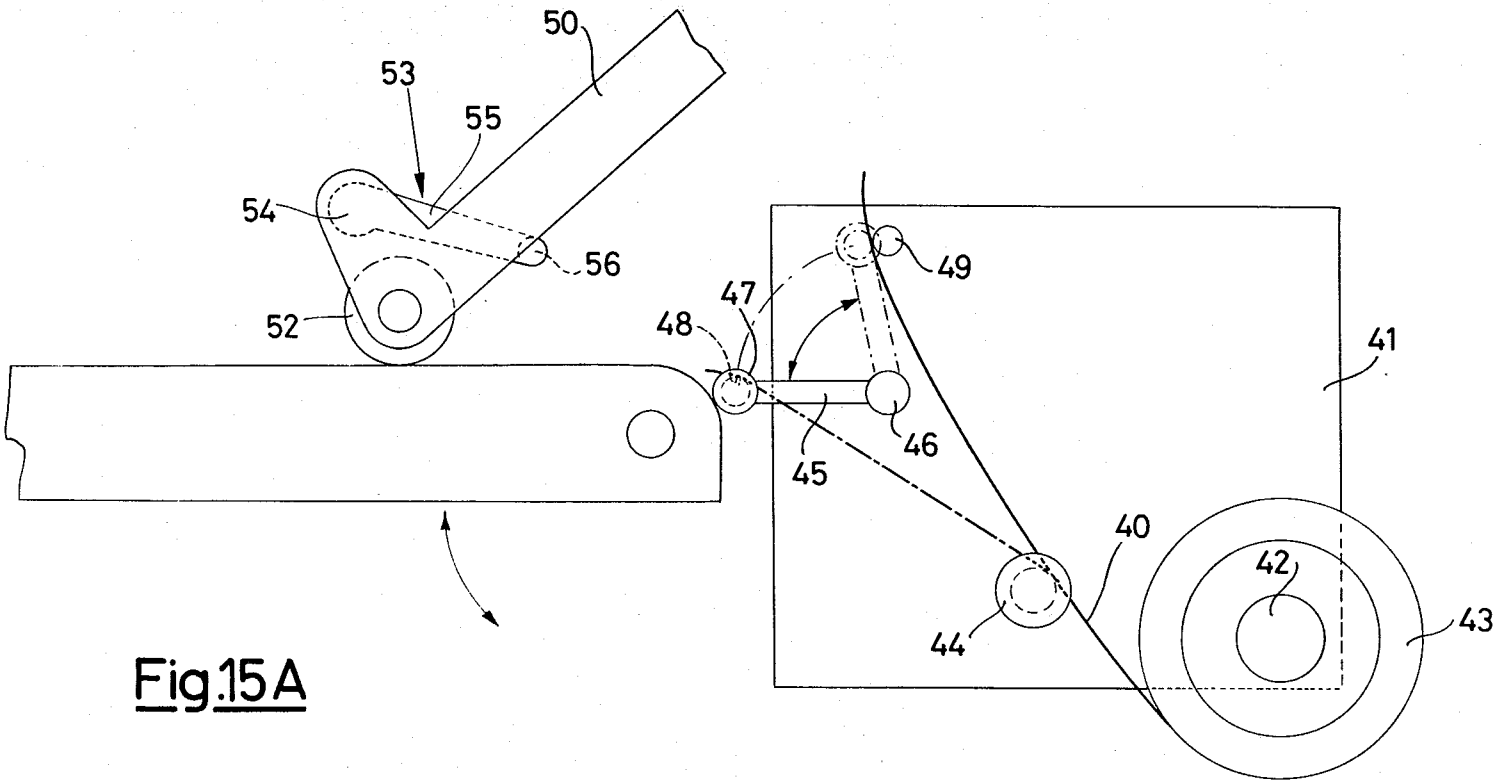

As it can be seen from FIG. 15A the feeding means for the adhesive tape splicing, generally indicated with number 40, include a plate 41 secured to frame 20, the plate having a reel 42, on which is mounted each time a coil 43 of adhesive tape 40, the reel 42 being equipped in a known manner with a clutch controlling the picking up of adhesive tape from the coil and the related pick up stretch. On the plate 41 is mounted a slide 44 for tape 40 in its motion until it will engage the free end of a positioning arm 45, movable between an operative picking up and laying off position (shown with full lines in FIG. 15A) and a resting position (shown with dotted lines) wherein it retains the adhesive tape edge awaiting for the next tape laying off operation.

The arm 45 is pivoted to plate 41 as shown with number 46, while the free end is equipped with a roller 47, having a bore or slit 48 connected with a suction system for the purpose of retaining the adhesive tape against the same roller. In the resting position the task of retaining the edge or free end of tape 40 is accomplished by cooperation between said roller 47 and a stationary pin or roll 49 for tape support.

Of course, the movement of arm 45 between the two afore said positions is controlled by means of known type and therefore not shown.

Figure 16:
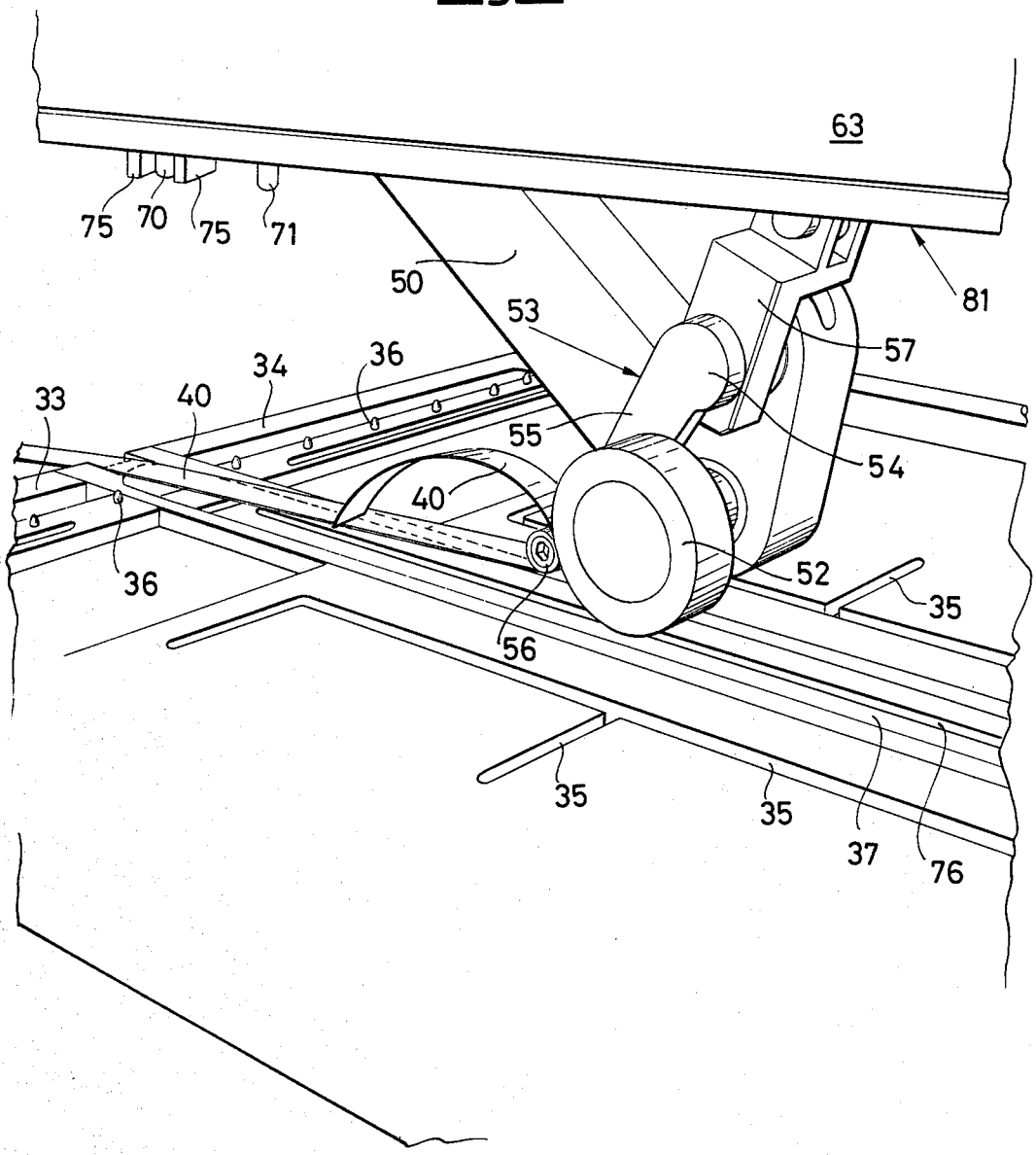
FIGS. 16 and 17, are views, respectively in detail and similar to FIG. 11, wherein the adhesive tape is in the laying off phase and unfolded and ready for the splicing.
Figure 17:
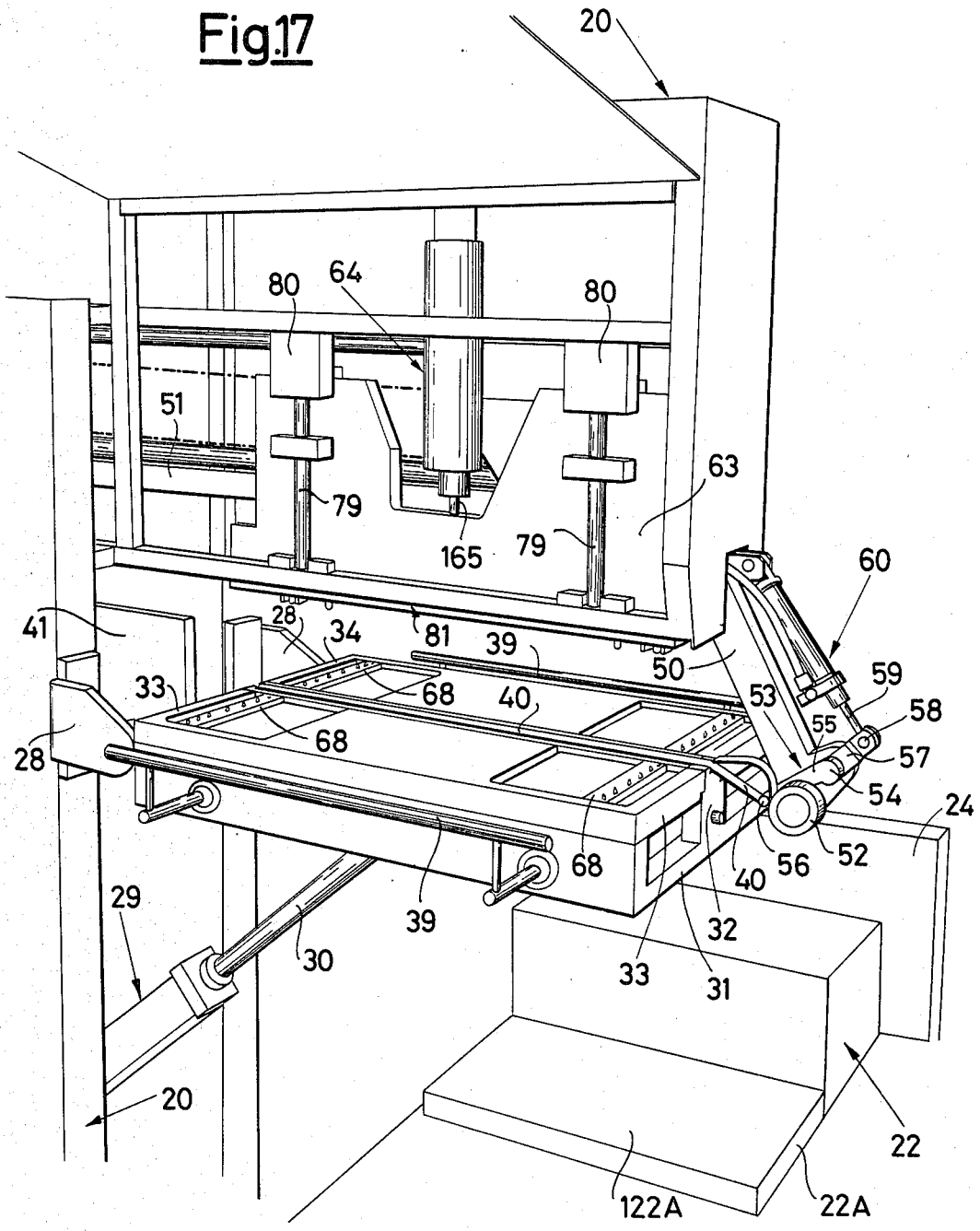

The pick up and lay off trolley for the adhesive tape 40, shown in detail through FIGS. 16 and 17, includes a block 50 having the uppermost end slidable onto a shaped slide 51 formed into the splicing head 26, the block 50 having a slider or idle roller 52 fit for covering the whole splicing plane along the splicing line M and having a width at least equal but preferably slightly greater than that of the adhesive tape to be laid off astride of the splicing median line M.

A lever 53, hinged at 54 to block 50, includes a first arm 55 terminating into a roller 56, that engages and keeps the adhesive tape, and a second arm 57 wherein the end is pivoted, by means of a stud 58, to the free end of the piston rod 59 of a cylinder-piston control assembly 60. It is evident that driving of assembly 60 will promote the rotation of the lever 53 between the position shown in FIG. 16, wherein the free edge of the adhesive tape 40 is caught and kept between roller 56 and idle roller 52, and the resting position, as shown for instance in FIG. 30, wherein the roller 56 is raised and does not interfere with the adhesive tape and the idle roller 52.

Figure 20:
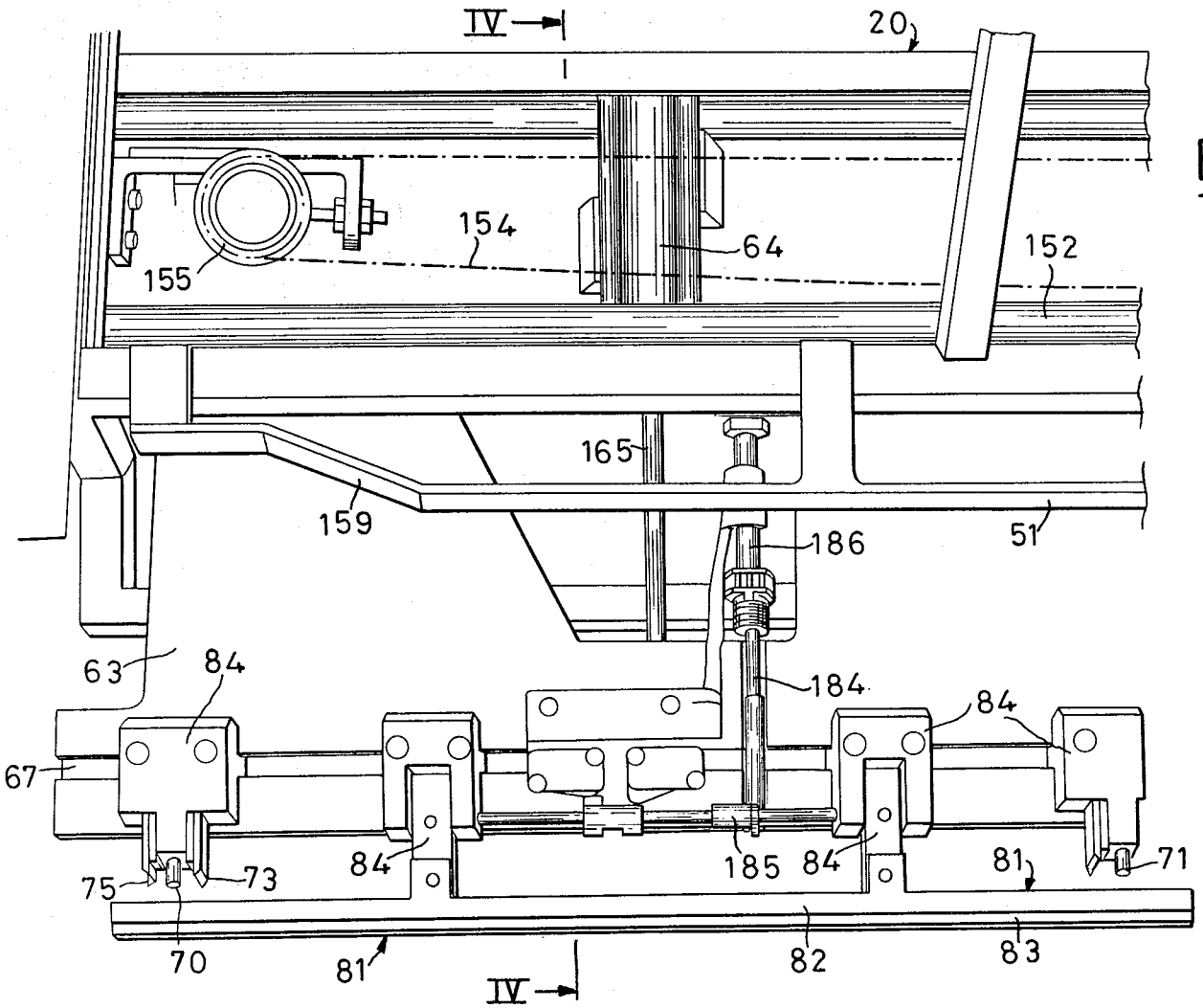
Figure 20A:
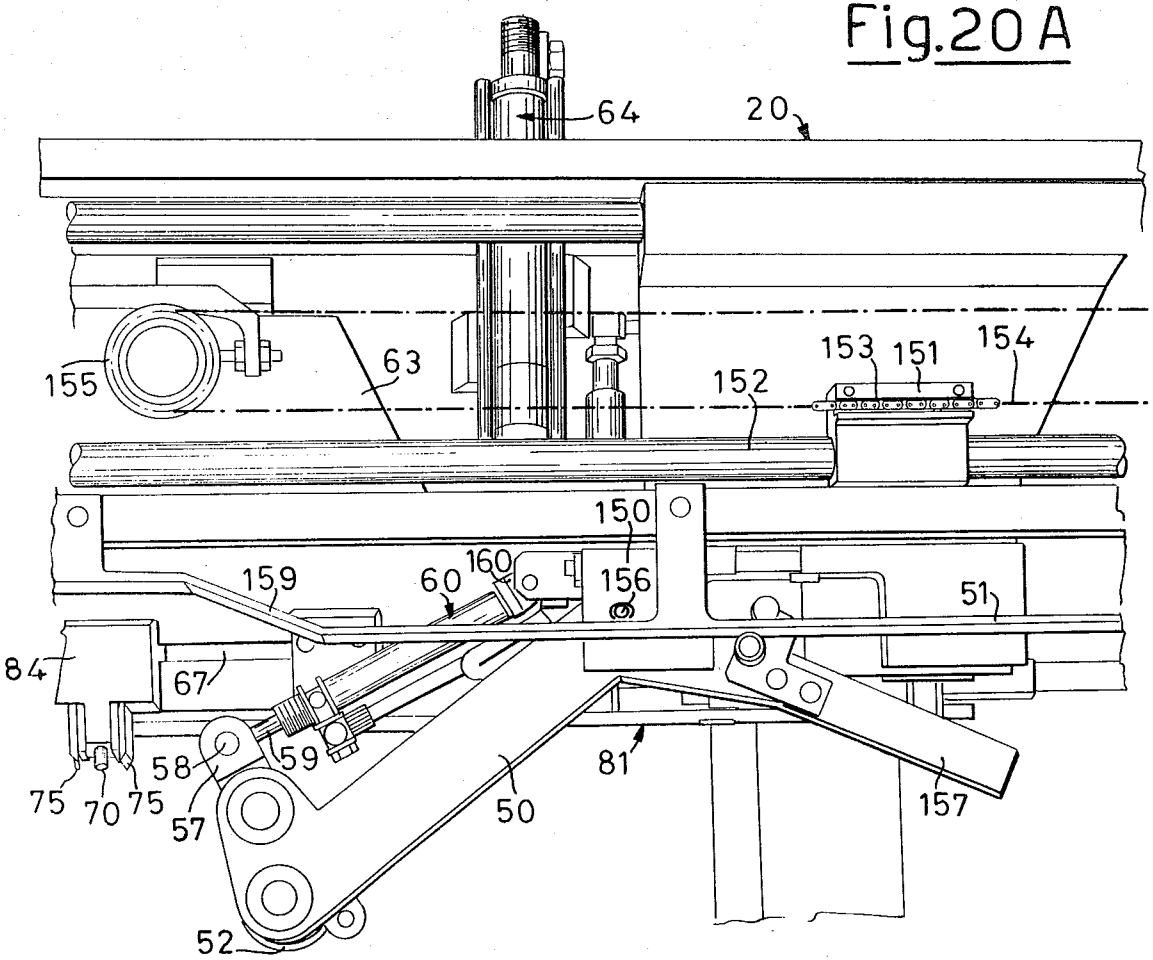
FIG. 20A is a detailed view, on an enlarged scale, of the guide means for the laying off means of the adhesive tape.
Figure 22:
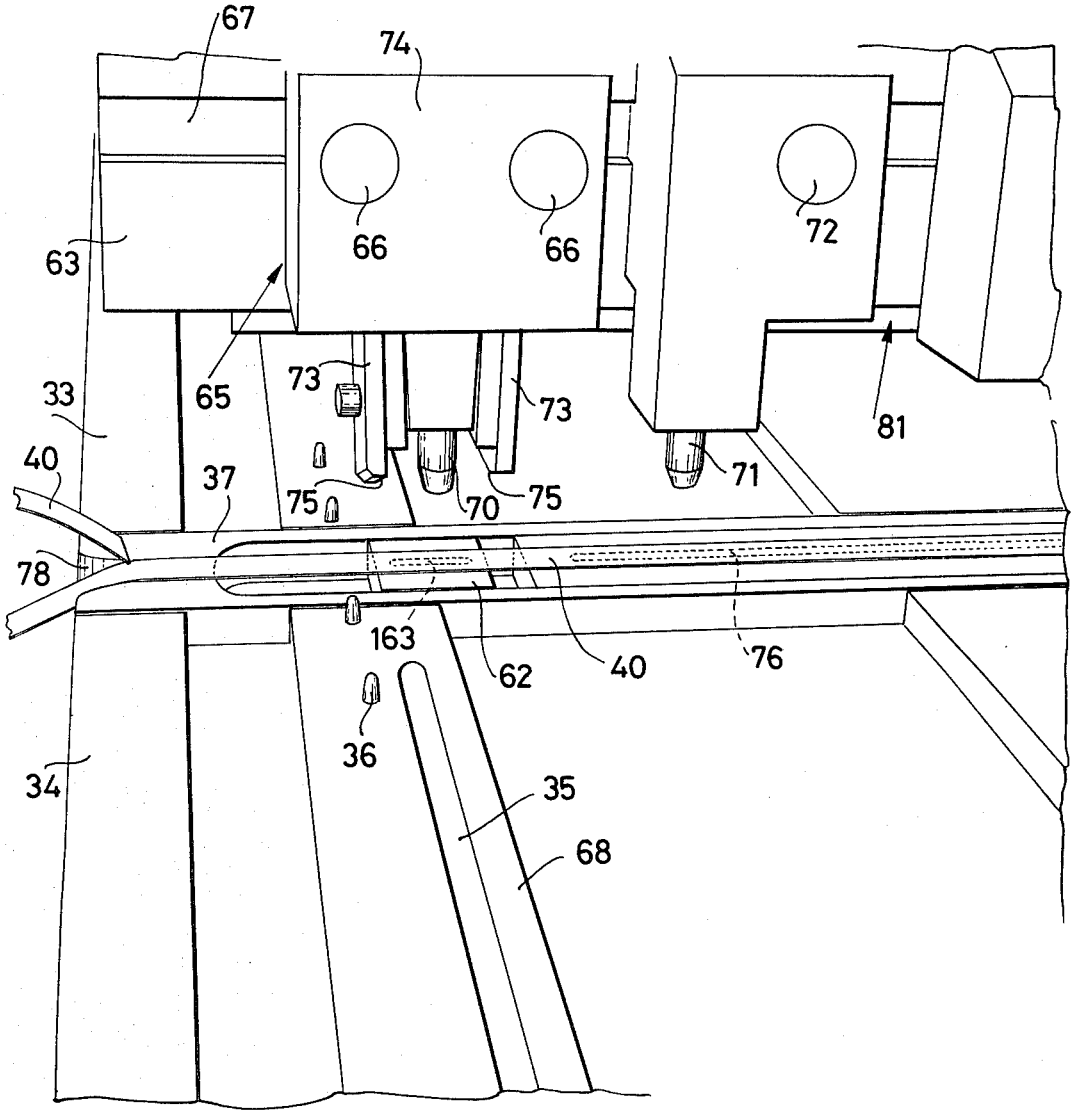
FIGS. 22 and 23 ar detailed views of cutting means corresponding to hollow punched areas of splicing sheets.
Figure 23:
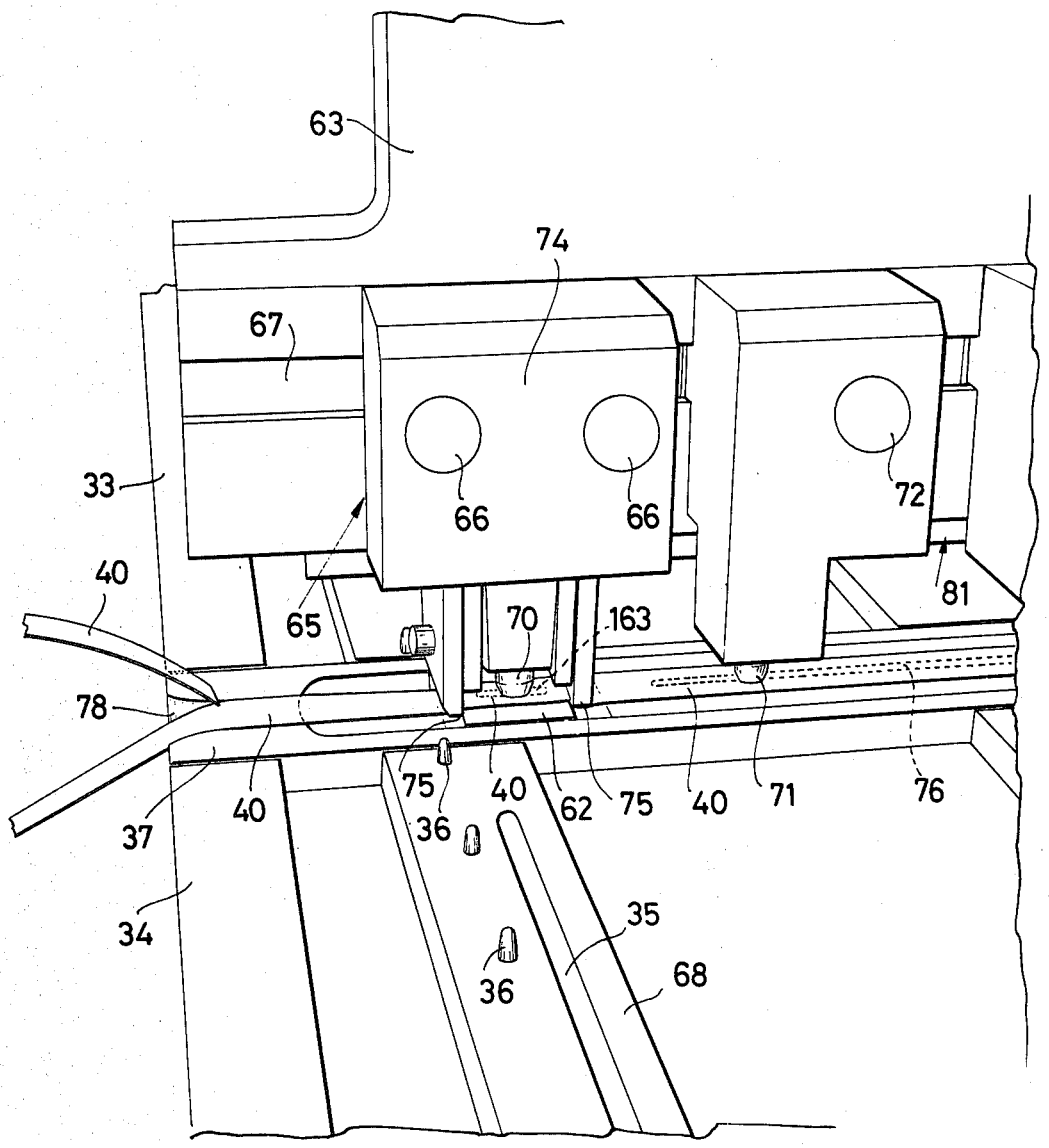
Figure 24:
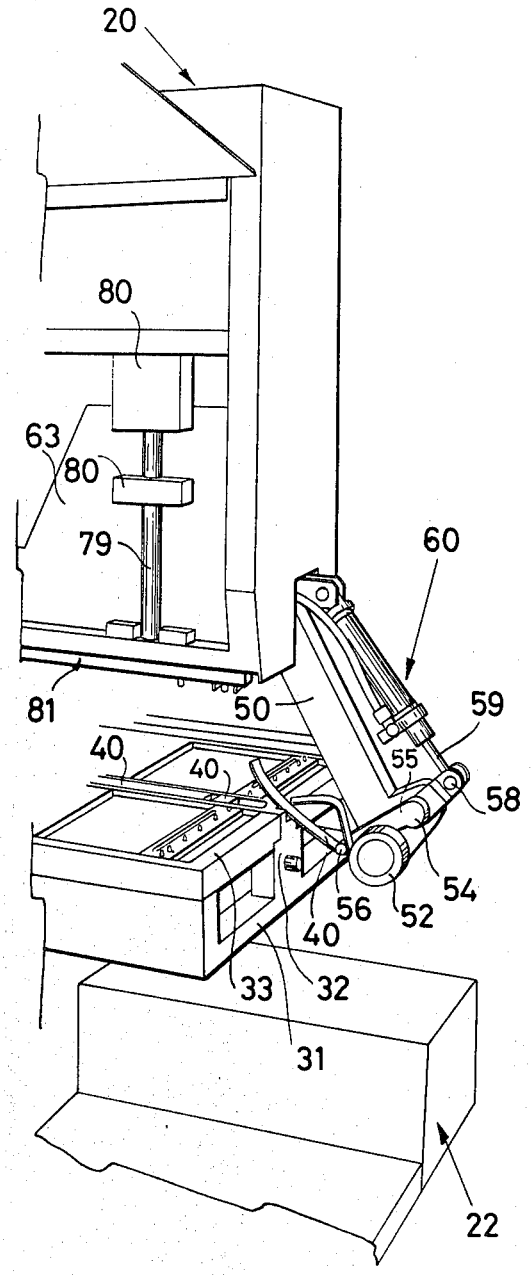
FIGS. 24 and 25 are partial views of operating positions of the adhesive tape laying off means after the cutting.
Figure 25:
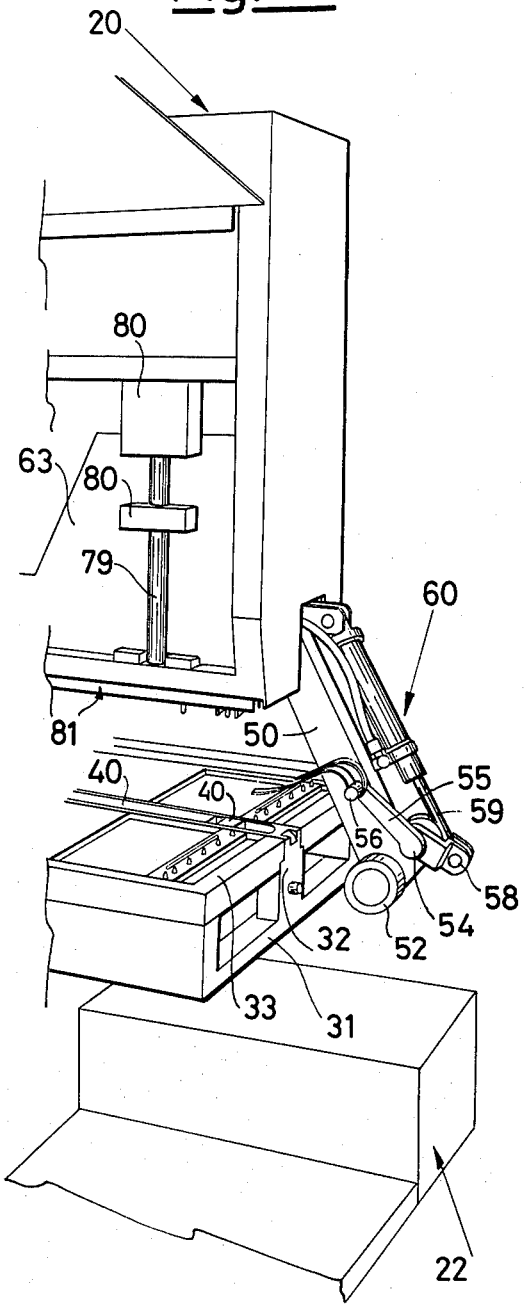
Figure 26:
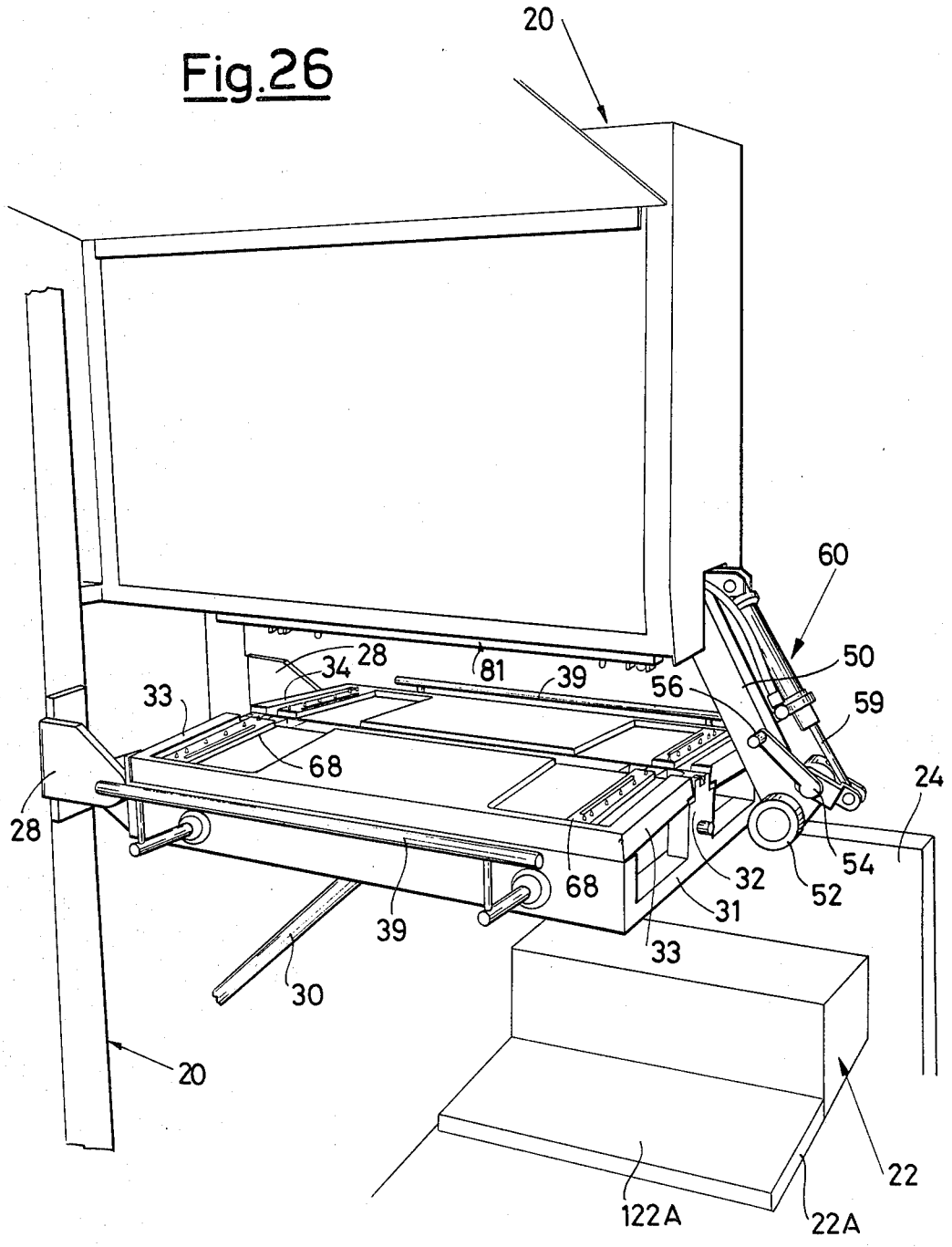
FIGS. 26 and 27 are views of the two splicing semiplanes, wherein the splicing sheets are respectively omitted and present.
Figure 27:
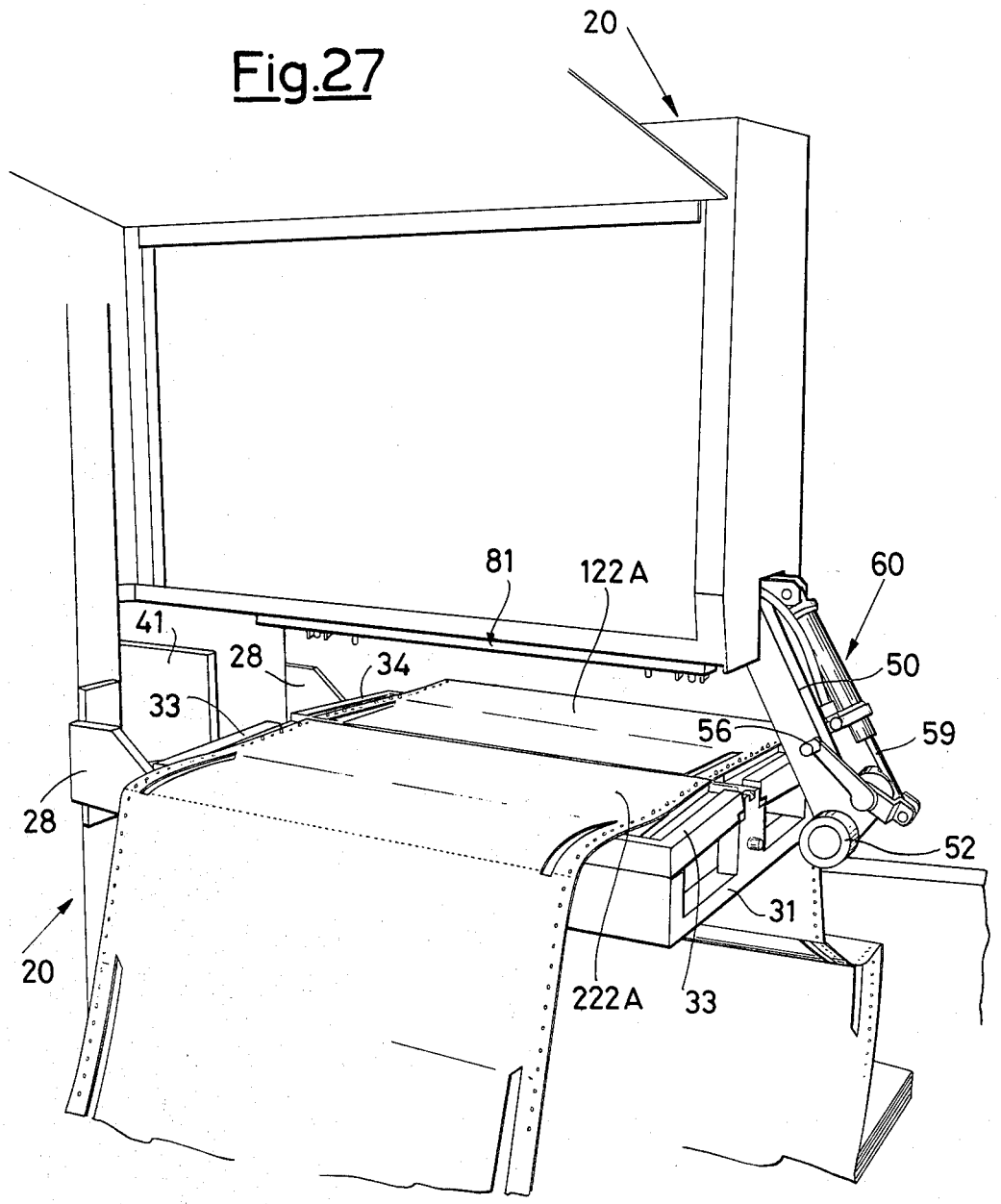
Figure 28:
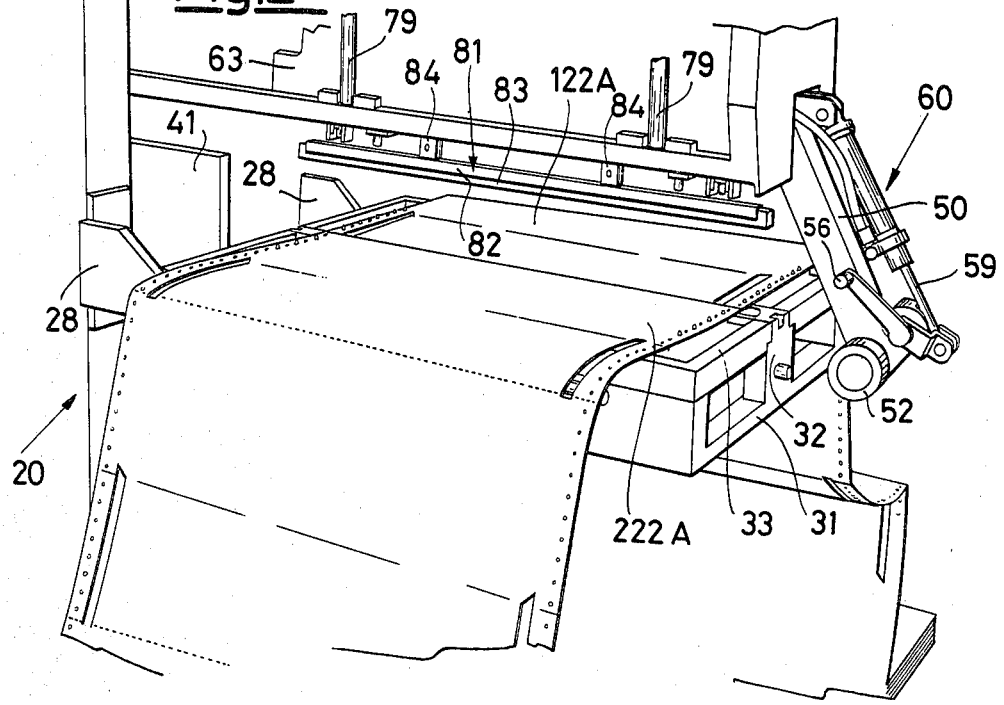
FIG. 28 is a view similar to FIG. 27 with the two splicing semiplanes in a different operating position, ready for splicing.

The block 50, for the sliding motion along the slide 51, is fastened (FIG. 20A) to a vertical plate 150, which has also secured thereto the fixed end 160 of the piston-cylinder assembly 60.

A sleeve 151, axially bored and slidable along a guide bar 152, is mounted to the plate 150, the sleeve 151 being L shaped in cross-section and being provided onto the lower surface of the short side of the L with a rack to which in turn a toothed chain 154 is geared.

The latter, driven by motor means (not shown), engages a gear 155, which is adjustably mounted to permit the tension of the chain to be adjusted.

Consequently the displacement of the chain in either direction shall cause the block 50 to be moved in one and in the opposite running direction.

The block 50 is pivotally mounted by means of a pin 156, to the vertical plate 150, and is formed with a rear extension 157 which, by means of the idle rollers 158, is linked during the sliding motion to the slide 51.

The latter has an inclined length 159 whereby, when the laying off device for the adhesive tape is at the end of the active run, the engagement of the roller 158 with the inclined length 159 causes the rotation of the block 50 around the pin 156, whereby the splicing plane is freed and the next operations are not hindered.

When the adhesive tape 40 has been laid off in correspondence and astride of the splicing line M, with its adhesive surface upwards, the tape itself must be cut and trimmed, either in correspondence of the ends of the above median line M, whereby it is split from the feeding coil and idle roller 52, and in correspondence of eventual areas wherein no splicing has to be carried out, for instance because the forms or sheets being spliced have hollow punchings. To this end, within the working face 37 there are provided grooves 61 into which there are placed blocks 62, slidable along said grooves and provided with single slits 63 connected with the suction source, similarly to slits 35. Consequently also blocks 62 act as anvils in the cutting and trimming steps. The cutting assembly, shown in particular in FIGS. 14, 18, 22 and 23, includes a plate 63 slidable between a raised or not operational position and a lowered or operational position, by means of a cylinder-piston assembly 64, the free end of the piston rod 65 being integral with plate 63.

The upwards and downwards run of plate 63 is guided through stationary guide bars 79, whereon bored blocks 80 run, rigidly secured to plate 63.

On the plate 63 there are secured blade assemblies generally shown with the number 65, which are adjustably mounted (for instance by means of screws 66 cooperating with the groove 67), so that they can be placed in correspondence with the beginning and ending of the splicing line M for the lengths of splicing, as well as in correspondence of blocks 62.

In this respect, it will be noted that also the pins or stakes 36 are mounted on bars 68 which are adjustably located, in accordance with the dimensions of the splicing sheets or forms within undercuts 69 provided into the splicing semi-planes 33 and 34.

Plate 63 supports moreover some tapeholder members, either in combination with blade assemblies 65, as shown with the reference 70, or independently, as shown with reference 71, the latter having the purpose of keeping the adhesive tape central area during the cutting.

Figure 14:
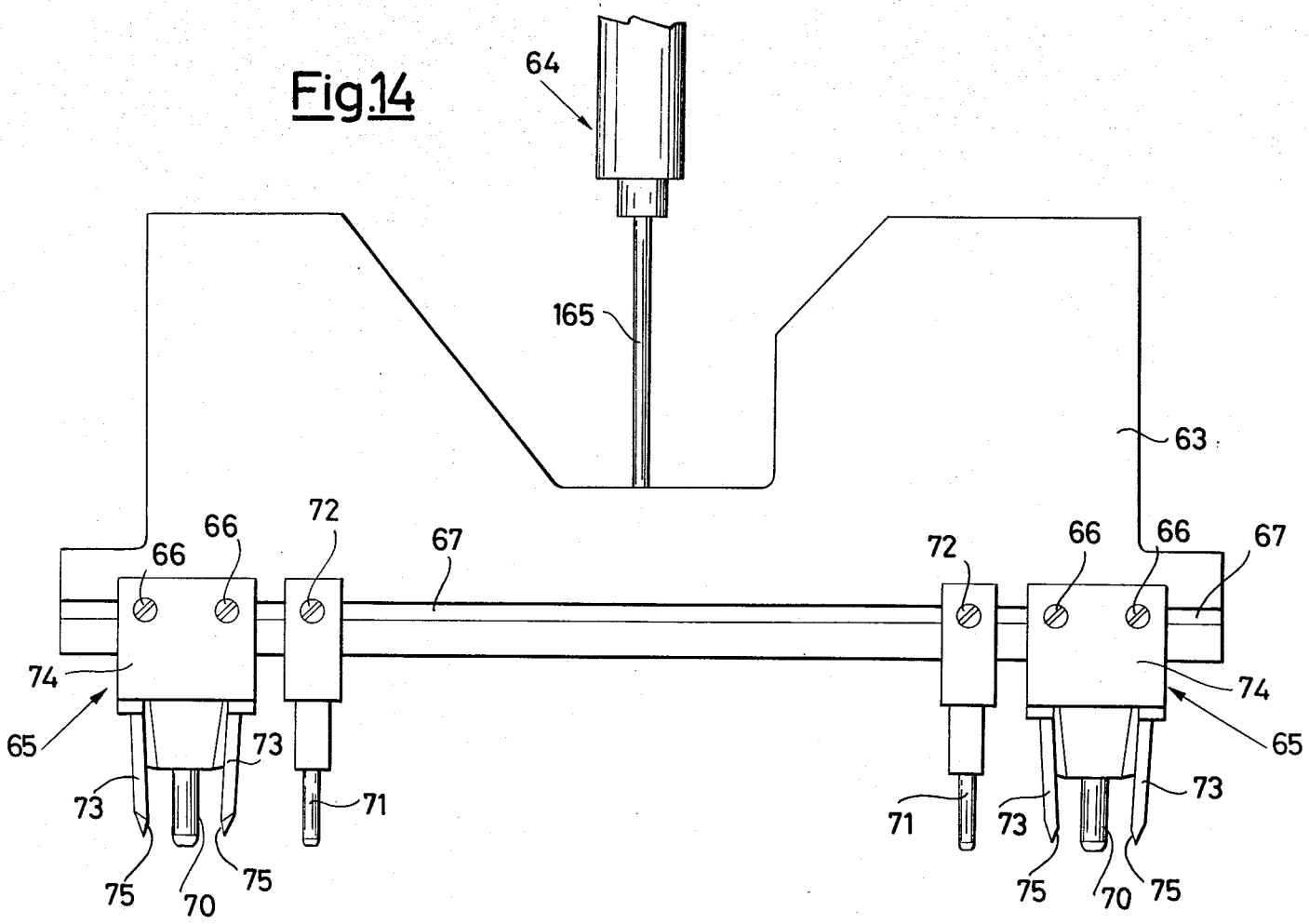
FIG. 14 is a schematic side elevation view of the cutting means.

As it will be seen from FIG. 14, also the pressors 71 are adjustably mounted by means of the screws 72 cooperating with groove 67.

The blades 73 of blade assemblies 65 are independently mounted amongst themselves to the blade holder blocks 74 and are likewise mounted in order to retract themselves becoming perfectly vertical during the cutting.

To this scope, the lower free end of each blade has a bevel 75 which cooperating with the corner of corresponding blocks 62, promotes the retraction.

When the adhesive tape is cut and trimmed as illustrated, it is kept into position by the suction action operating through slits 63 obtained within blocks 62 and a similar slit 76 formed into the working face 37 of partition 32. The latter, as shown into FIG. 13, has likewise inlet and outlet notches 77 and 78, that receive and guide the adhesive tape in its positioning by the idle roller, the tape 40 being stretched, before cutting and hence prior to engagement by pressors, between the feeding coil and the lay off idle roller. It is advisable to point out that, in cases wherein the hollow punchings are not present within the splicing sheets or forms, the blade 73 more internal in respect of plane 25 of each cutting assembly 65 will be omitted.

To press the edges of the two splicing sheets on the splicing tape adhesive face (in accordance with the operational mode that will be hereinafter illustrated), it is provided a pressing member (FIGS. 28 and 29) including an horizontal bar 81, fit for matching with the active upper surface 37 along the splicing median line M, the bar 81 including a channel section 82, into which is seated a sliding block 83 of rubber or other not rigid material.

Figure 18:
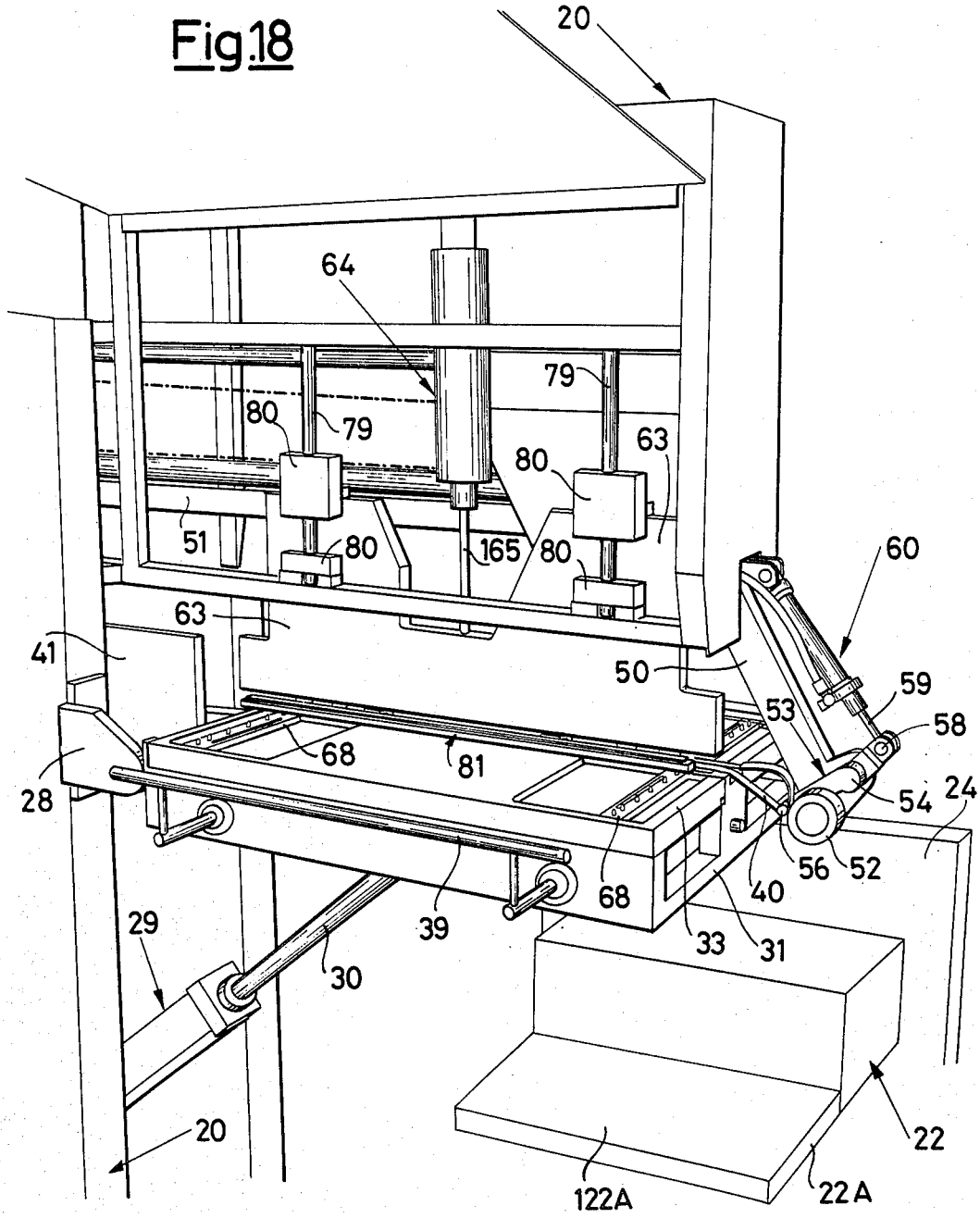
FIG. 18 is a view similar to FIG. 16 with cutting means in the phase of cutting and trimming the adhesive tape.
Figure 19:
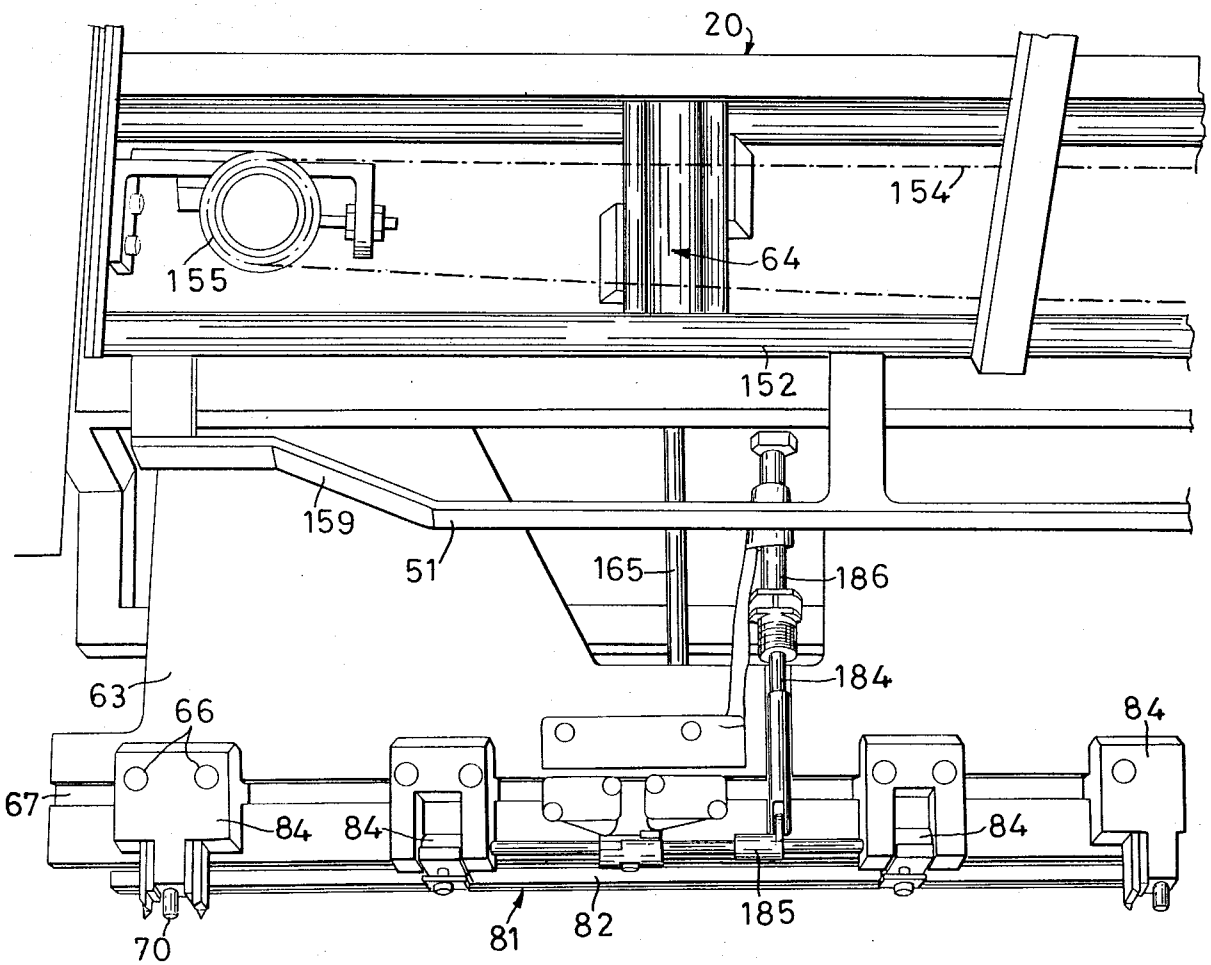
FIGS. 19 and 20 are elevation views of the cutting and trimming means for the adhesive tape, from the opposite side with respect to the FIGS. 17 and 18.
Figure 29:
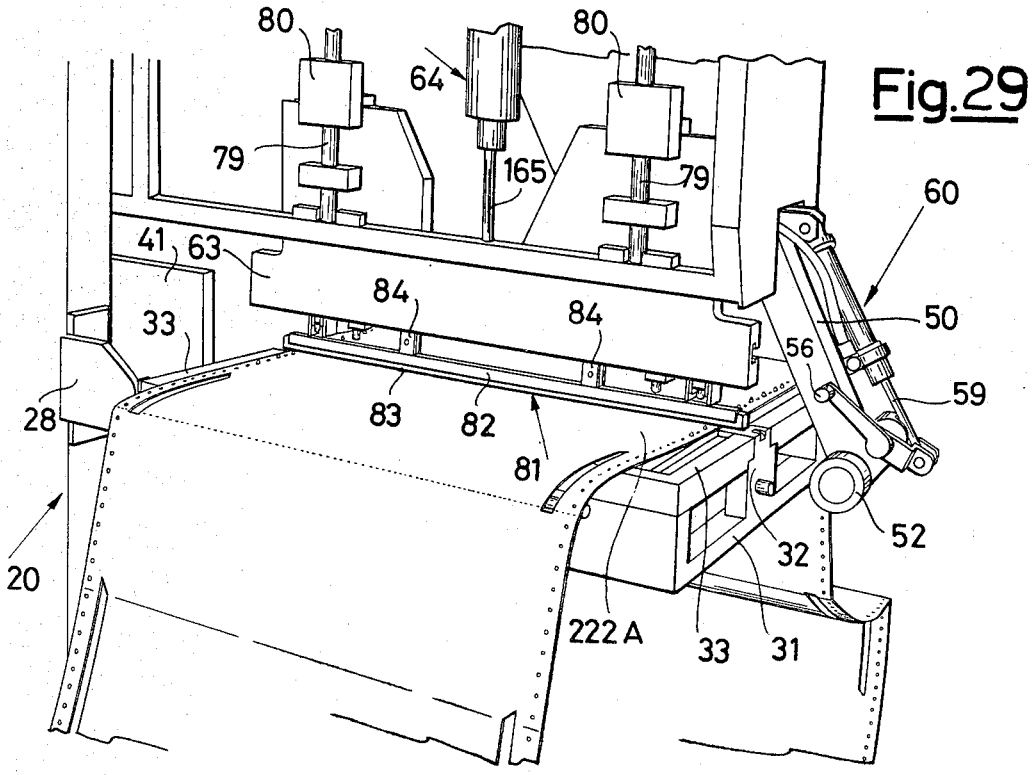
FIG. 29 is a view similar to FIG. 28, with the pressing means in the operating position.
Figure 30:
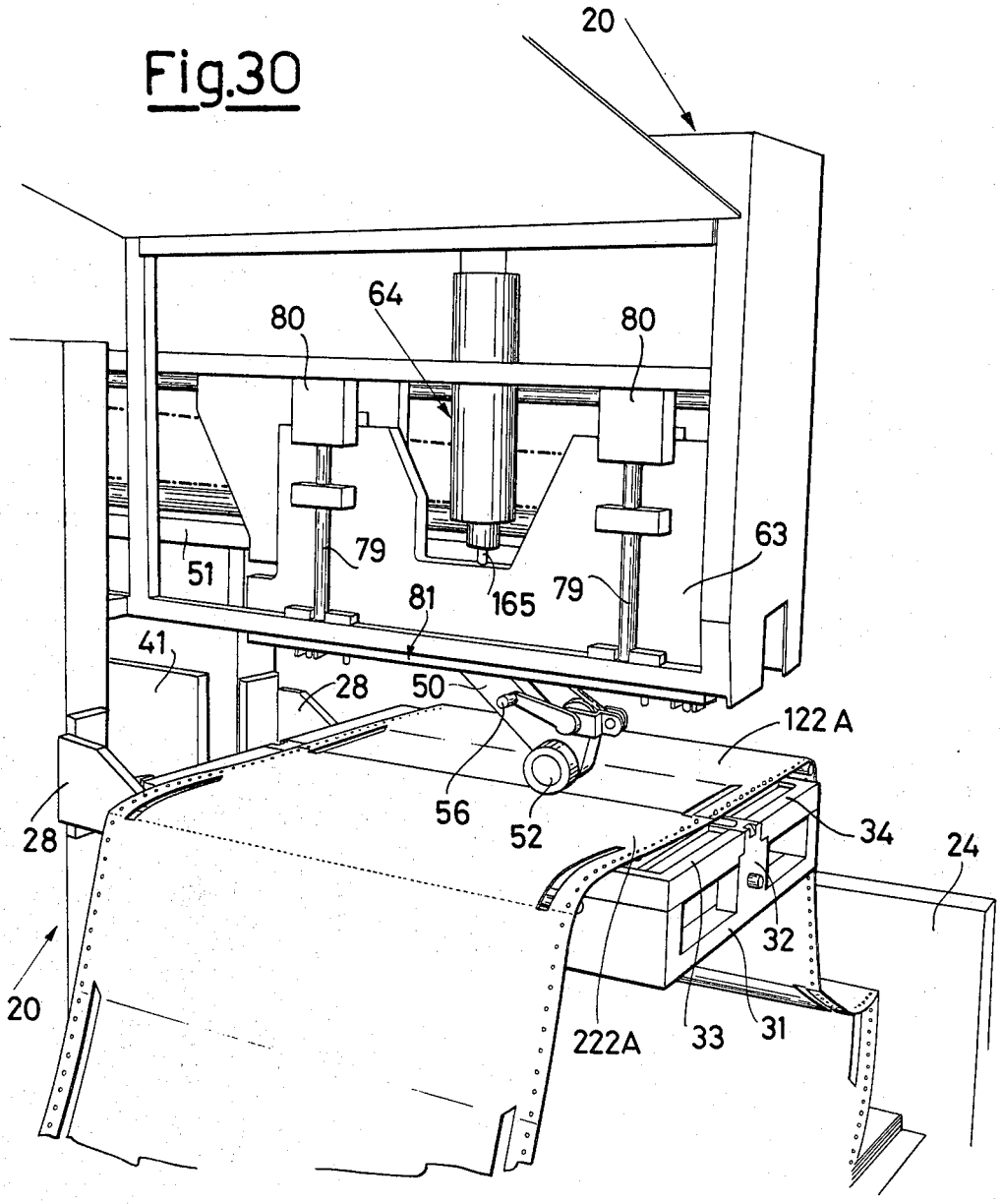
FIG. 30 is a view similar to FIG. 29, that shows the coming back and pressing of the adhesive tape laying off means.
Figure 31:
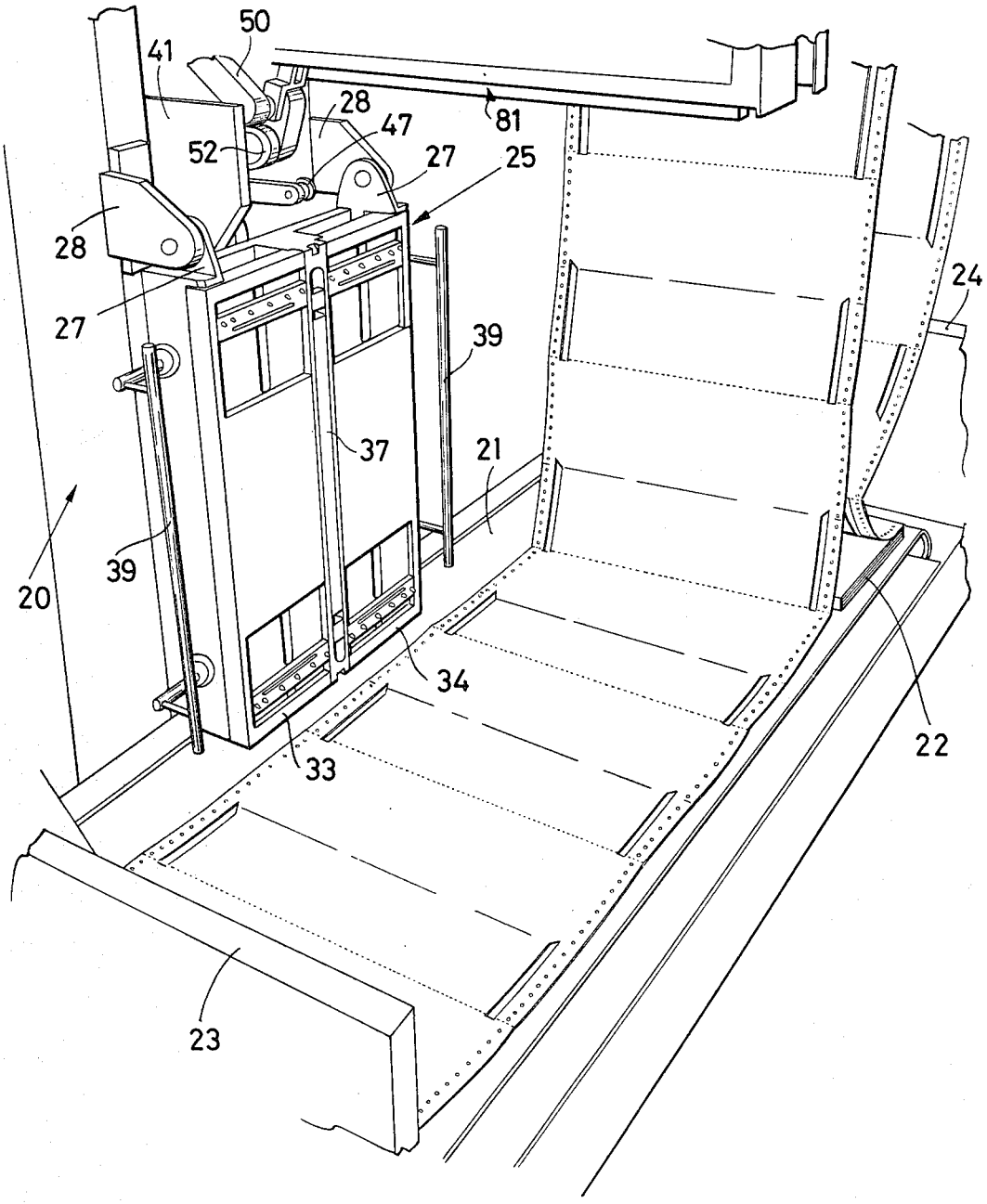
FIG. 31 shows the machine in the coming back phase, in non operating condition, upon splicing completion.

The bar 81 is mounted on plate 63 by means of hinge blocks 84 secured to plate 63, which permit rotation of bar 81 between the operational position shown in FIG. 29 and a resting position shown in FIG. 18, the said rotation being controlled by known means such as the piston 184 actuating a cam-like member 185, the piston 184 sliding into a cylinder 186 under air or oil pressure.

The operation of the apparatus in accordance with the invention will be now illustrated with reference to figures, in particular to FIGS. 11, 12, 17, 18, 24, 25, 26, 27, 28, 29, 30 and 31, and with reference to pre-printed and pre-hollow-punched forms, joined in a continuous manner and folded to make packages, such as that shown in FIG. 11 with the reference 22.

The peculiarity of these form packages is that of containing a number of forms (indicated with the reference 22A) which in assembling are arranged sideways, that is either perpendicular or parallel to the general lie plan of forms within the package 22 and, when the assembling is opened and the package placed on plane 21, the sheets or forms 22A will be flatwise on plane 21, in parallel with package 22, so that the last form 122 will be available for the splicing operation.

With the apparatus in resting condition as shown in FIG. 11, it is supposed that the form package 22 is in feeding phase to a processing station (for instance a fast printing accounting center for invoice processing and output).

In order to avoid unduly stops within the working cycle of the above station it is necessary splicing the last form 122A with the first form 222A of another similar form package 222 which is loaded on the plane 21 adjacent to board 23, the package 222 being however similar to package 22.

To start the splicing operation there will be operated the cylinder-piston assembly 29, whereby the extension of rod 30 takes the splicing plane 25 into the operational piston of FIG. 12.

Before placing the splicing forms on plane 25 there will be laid off, in correspondence to the splicing median line M on the working surface 37 of partition 32, a strip of adhesive tape 40 with the adhesive face upwards.

To this end, the arm 45 (FIG. 15A) is rotated towards said operational position, carrying with itself the free end of the adhesive tape 40, by virtue of the suction action acting through bore 48.

In turn, the lever 53 is operated by means of the jack 60 in order to bring the roller 56 from the resting position, shown in FIG. 15, to the operational position shown in FIG. 16. In this motion, the roller 56 is moved above and behind the free end of tape 40, engaging its adhesive face and extracting the same until it will be in contact and locked against the rotation surface of the idle roller 52.

At this point the block 50 is driven to run along the slide 51, whereby tape 40 is picked up from the feeding coil 43 and laid off along and above said median line M.

At the end of this run, the block 50 stops itself, while the assembly including roller 52 and lever 53 with relating roller 56 releases the splicing plane 25. As a result of the lowering of roller 52 in respect of the splicing plane and also of the presence of notches 78, the tape 40 remains adherent and stretched onto the working surface 37, covering likewise the movable blocks 62 of grooves 61 that had been previously located in function of eventual hollow punchings within forms 122A and 222A. The position of supports 68 within undercuts 69 had been likewise adjusted, in order to align pins 36 with the marginal borings of splicing forms in the manner previously discussed.

At this stage the apparatus is in the condition illustrated in FIG. 17, whereby it will be necessary to cutting and trimming the adhesive tape to have it perfectly matched with the splicing forms and hence with eventual hollow punchings provided into the forms in question.

Figure 13:
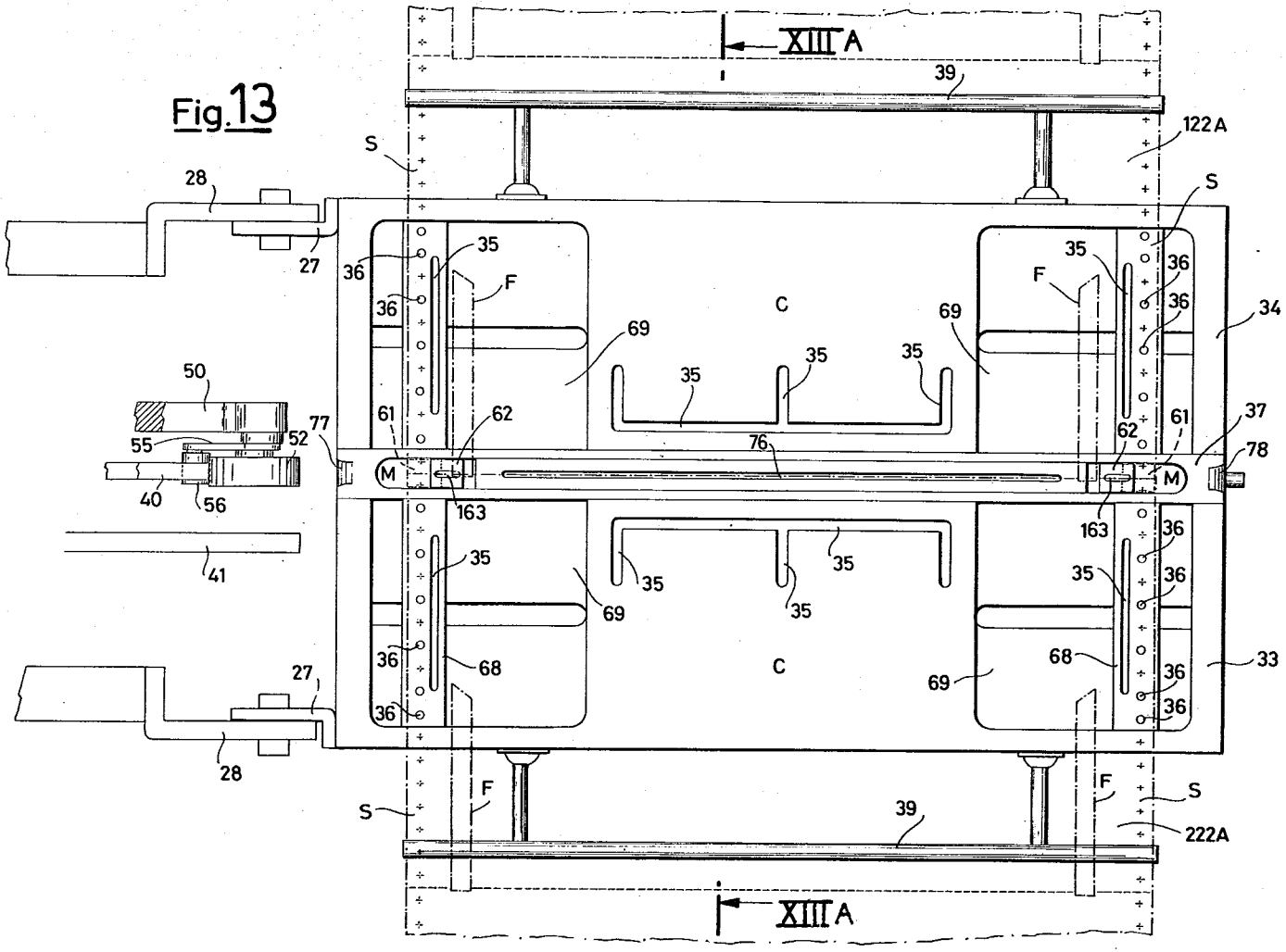
FIG. 13 is a plan view of the splicing plane.

As it can in effect be seen in FIG. 13 and FIGS. from 27 through 31, each form (122 and 222) inclues a central area (C), two hollow punchings (F) that laterally delimit, at least partly, the central area, separating it from two lateral strips (S), that carry holes spaced by a constant step and intended for tearing from the very form upon processing and printing and for utilization (enveloping, mailing, etc) of signal forms.

From FIG. 13 it can be clearly seen how blocks 62 are positioned in order to be aligned with said lateral strips, leaving an intermediate void space between block and inner end of groove 61 correspondingly to hollow punching F.

In these conditions, upon similar position adjustment of cutting assemblies secured to plate 63, the latter is lowered (FIG. 18), thus cutting the adhesive tape 40 in correspondence with full portions of the working surface 37.

The adhesive tape portions that remain on said surface 37, are after cutting, retained in place by the suction operating throughout slits 63 and 76.

At the same time the jack 60 is operated thus rotating the roller 56 towards the not operational position, whereby the adhesive tape length that was retained by roller 52 can be released and discarded.

At the same time the arm 45 rotates towards the resting position thereby retaining the adhesive tape free end by means of the suction acting throughout the slit 48 of roller 47.

It will be now possible placing the splicing forms 122A and 222A on the two semi-planes 33 and 34 so that the respective splicing free edges are aligned and matching said median line M. As on such median line there is already the splicing adhesive tape with its adhesive face upwards, it is clear that it hampers the probable position adjustments of the two forms, which will not likely be at the precise splicing position when initially positioned on the relative semi-plane. To this end the two semi-planes 33 and 34, prior to form positioning, are taken to their said slanting position, whereby their edge adjacent to the splicing median line M, is raised of a small distance in respect to surface 37.

In this manner there will be possible carrying out the eventual position adjustments of forms without unduly interfering with the adhesive tape.

It has to be pointed out the fact that the splicing forms, once correctly positioned, are kept in such position by the suction acting throughout slits 35. For what attains to form 122A and 222A positioning on the respective splicing semi-planes, or more precisely their picking up from the respective package, it will be manually carried out in the case of a semi-automatic apparatus. In the case of a completely automatic apparatus there are provided automatic devices of the type, for instance, having an arm equipped with suction cups or suckers, rotating between a pick up position of the respective sheet or form and a release position on the respective splicing semi-plane.

As these are well known deivces in the art of paper and, in general sheet material handling, their specific representation or a more detailed description will not be made.

When the two splicing sheets or forms are positioned, the apparatus is ready for the very splicing operation.

To this end, the pressing bar 81 is taken into operational position (FIG. 28) and the lowering of plate 63 (FIG. 29) is driven. In carrying out this motion, the bar engages the edges of the two semi-planes 33 and 34 returning them back flush with the splicing face 37 and presses the two forms, now matching along their free edges in correspondence with and matching said median line M, against the adhesive face of splicing tape 40, which as already pointed out, shows exactly in corresponsence with M line a slit or boring for the successive tearing upon processing of the two spliced forms within the processing and printing station.

In order to trim and ensure the splicing, on the whole adhesive face of tape 40 there takes place now the return run of roller 52 and hence of block 50 (FIG. 30) that presses the two forms already secured to the adhesive tape against the same and along its complete length, hence ensuring the splicing not only for the complete length of the splicing line M, but also for the complete width of the adhesive tape 40.

The splicing operation is at this point completed, whereby it will be only necessary operating the cylinder-piston assembly 29 promoting the re-entry of rod 30 and hence the lowering of plane 25 (FIG. 31), thereupon having the first form of package 222 spliced to the last form of package 22 and when the latter will be exhausted the package 222 is transferred in the place of package 22, for instance by making the support plan 21 as a conveyor belt which is moved intermittently with the splicing machine working cycles.

As already pointed out, the invention has been described in relationship to a preferred embodiment, there being understood that changes and modifications, conceptually and mechanically equivalent also of single components and devices forming the apparatus of the invention are possible and foreseeable without departing from its limits.

Among the advantages obtained through the present invention, in addition to those already mentioned and in particular to the mechanization and automation of sheet and form feeding to fast printing and data processing stations, it is also worth mentioning the advantage of having the form feeding operators away from the printing machine, a condition which previously was mandatory.

Recent studies have in effect evidenced, especially in the case of laser printing machines, the danger of such proximity from the health standpoint.

I claim:

1. Apparatus for the continuous feeding of individual forms from a plurality of single forms to a fast printing machine, wherein the individual forms are assembled into respective packages in which said single forms therein are united among themselves at least along two side margins, the apparatus splicing the last form of one package to the first form of another package, the apparatus comprising a splicing plane;

means for temporarily retaining respective sheets disposed on said splicing plane with respective edges thereof disposed in edge abutting relationship;

means for feeding a tape;

means for application of a splicing adhesive tape, said means for application being movable between a pick up position of the tape fed by said means for feeding and a position in which the adhesive tape is registered with respect to the edge abutting splicing edges; and means for cutting and trimming the adhesive tape in correspondence to prefixed and adjustable positions; and presser means dimensioned and configured to engage the two adjacent edge abutting edges to be spliced and press them against the adhesive face of the adhesive tape, the tape having a notched or bored line to separate by tearing the two spliced sheets.

2. Apparatus for the splicing of sheet material in accordance with claim 1, further including a frame and a splicing head projecting from said frame, said splicing head being disposed proximate to said splicing plane.

3. Apparatus for the continuous feeding of individual forms from a plurality of single forms to a fast printing machine, wherein the individual forms are assembled into respective packages in which said single forms therein are united among themselves at least along two side margins, the apparatus splicing the last form of one package to the first form of another package, the apparatus comprising a splicing plane;

means for temporarily retaining respective sheets disposed on said splicing plane with respective edges thereof disposed in edge abutting relationship; and said splicing plane including two semi-planes which are coplanar, said semi-planes being movable between a first position which is registered intermediate respective packages and a second position spaced apart from said packages.

4. Apparatus for splicing of sheet material in accordance with claim 3, further including slits for application of a vacuum to respective forms to position them with respect to said semi-planes.

5. Apparatus for the splicing of sheet material in accordance with claim 4, wherein said semi-planes are equipped with lateral members, adjustable in accordance with the width of splicing sheets, said lateral members having pins projecting therefrom which are positioned to engage uniformly spaced marginal holes disposed along edges of said forms.

6. Apparatus for the splicing of sheet material in accordance with claim 4, wherein said semi-planes have a stationary partition having the upper face coplanar with said semi-planes, an upper face of said stationary partition having grooves having removable blocks slidingly housed for identifying insulated splicing areas in correspondence with areas wherein splicing is missing identified by said grooves.

7. Apparatus for the splicing of sheet material in accordance with claim 6, wherein each of said removable blocks has slits for communication with an associated vacuum source.

8. Apparatus for the splicing of sheet material in accordance with claim 1, wherein said splicing plane is assembled to said frame at one of its ends and is rotatable between a horizontal splicing position and a vertical resting position, the motion between said two positions being carried out by means of a cylinder-piston assembly, wherein the free end of the rod of said piston is pivotally joined to the back face of said splicing plane.

9. Apparatus for the continuous feeding of individual forms from a plurality of single forms to a fast printing machine, wherein the individual forms are assembled into respective packages in which said single forms therein are united among themselves at least along two side margins, the apparatus splicing the last form of one package to the first form of another package, the apparatus comprising a splicing plane;

means for temporarily retaining respective sheets disposed on said splicing plane with respective edges thereof disposed in edge abutting relationship; and means for applying a tape include a clutch roll, on which is assembled an adhesive tape coil and a guiding and keeping arm, pivoted at one end and equipped at the opposed end with a roller having at least one suction port communicating with an associated vacuum source, said arm being rotatable between a resting position and an operational position, wherein said tape is engaged and picked up by uncoiling of said coil by said means for applying.

10. Apparatus for the splicing of sheet material in accordance with claim 9, wherein said means for application of said adhesive tape include a support block asssembled to said head and slidingly driven from one end to the other of the same head, an application roller idler assembled to the lower end of said block and slidingly engaged with said upper face of said stationary partition of said splicing plane and a lever, hinged at one of its intermediate positions to said block and having one end with a pick up and keeping roller, dimensioned and configured for catching the free end of said adhesive tape retained by said roller ending said arm and transferring it, into contact and retained condition, against said idler roller, the other end of said lever being hinge-connected to the free end of the rod of a cylinder-piston assembly for driving the motion of said roller between said retaining position of said tape against said idler roller and said resting position.

11. Apparatus for the splicing of sheet material in accordance with claim 1, wherein said cutting and trimming means include a support plate, slidingly assembled to said head between a raised resting position and a lowered operational position, cylinder and piston means for moving said plate between said two positions, blade cutting means secured adjustably to said plate and that, within said operational position of said plate, engage said adhesive tape already laid off onto said upper face of said splicing plane cutting the tape at least at the two ends of the desired splicing area.

12. Apparatus for the splicing of sheet material in accordance with claim 11, wherein said blade cutting means are independently assembled to a blade holding block adjustably secured to said plate, each blade having a bevel permitting its perfect verticalness during the cutting phase.

13. Apparatus for the splicing of sheet material in accordance with claim 12, further including one of said blade holding blocks for each of said removable blocks housed within said grooves of said upper face of said stationary partition, the blades being assembled to said blade holding block in a movable position between a resting position wherein they converge towards the interior of said blade holding block and an operation position, as determined by the engagement of each blade bevel with the corresponding corner of said removable block, thus cutting out within said adhesive tape a continuous central strip and two lateral areas, between each lateral area and the continuous strip there remaining areas without adhesive tape that correspond in width to hollow punchings prearranged within the splicing sheets.

14. Apparatus for the splicing of sheet material in accordance with claim 13, further including pressers secured to said plate, dimensioned and configured for engaging said adhesive tape central strip during the whole cutting and trimming phase.

15. Apparatus for the splicing of sheet material in accordance with claim 14, wherein said presser means includes a bar mounted to said support plate and movable between a resting position wherein it is bent laterally and parallely to the edge of the same plate and an operational position wherein it protrudes below the lower ends of said cutting blades and said support plate, thus engaging the splicing sheets in correspondence to said upper face of said stationary partition.

16. Apparatus for the splicing of sheet material in accordance with claim 15, wherein the pressing bar includes a channel member wherein is housed a sliding block of resilient material for engaging the splicing sheets.

17. Apparatus for the splicing of sheet material in accordance with claim 15, wherein said bar is secured to said plate by means of hinge connections movable between said two positions.

18. Apparatus for the splicing of sheet material according to claim 10, wherein said block of said pick up and lay off means for the adhesive tape is engaged with running guide means, the latter having an inclined portion engaged by said block at the end of the operational run.

19. Apparatus for the splicing of sheet material according to claim 18, wherein said block comprises a rear extension, engaged through a pair of idler rollers with the upper and lower surface respectively of said guide means.

* * * * *